US010950122B2

(12) United States Patent
Ling

(10) Patent No.: US 10,950,122 B2
(45) Date of Patent: Mar. 16, 2021

(54) SYSTEM AND METHOD FOR A DISTRIBUTED SENSING FLASHING BEACON FOR ALERTING VEHICLE DRIVERS

(71) Applicant: Bo Ling, Norfolk, MA (US)

(72) Inventor: Bo Ling, Norfolk, MA (US)

( * ) Notice: Subject to any disclaimer, the term of this patent is extended or adjusted under 35 U.S.C. 154(b) by 0 days.

(21) Appl. No.: 16/351,388

(22) Filed: Mar. 12, 2019

(65) Prior Publication Data

US 2019/0304294 A1 Oct. 3, 2019

Related U.S. Application Data

(60) Provisional application No. 62/761,093, filed on Mar. 12, 2018.

(51) Int. Cl.
*G08G 1/01* (2006.01)
*G08B 5/38* (2006.01)

(52) U.S. Cl.
CPC ..... *G08G 1/01* (2013.01); *G08B 5/38* (2013.01)

(58) Field of Classification Search
CPC ..... G08G 1/07; G08B 5/38
USPC ..... 340/933, 905, 907, 917, 944, 10.1
See application file for complete search history.

(56) References Cited

U.S. PATENT DOCUMENTS 9,215,778 B2 * 12/2015 Amarin ..... H05B 37/0272
2004/0183694 A1 * 9/2004 Bauer ..... G08G 1/095 340/907
2005/0128105 A1 * 6/2005 Green ..... B29C 39/10 340/944
2008/0018494 A1 * 1/2008 Waite ..... E01F 9/615 340/907
2013/0049985 A1 * 2/2013 Eisenson ..... G08G 1/0965 340/902
2013/0181849 A1 * 7/2013 Cai ..... G08G 1/09 340/905

* cited by examiner

*Primary Examiner* — Tai T Nguyen
(74) *Attorney, Agent, or Firm* — Ariel S. Bentolila; Bay Area IP Group, LLC

(57) ABSTRACT

A system is provided for distributed sensing and flashing of a beacon or sign for alerting vehicle drivers. A version is provided where a solar flasher having a wireless receiver is configured with multiple strategically located sensors to detect pedestrian and vehicle motion and wirelessly transmit detections to the beacon or sign. A method of locating and processing the sensors is provided to enable detection of various dangerous pedestrian and vehicle motion patterns to thereby alert on-coming drivers.

20 Claims, 13 Drawing Sheets

SYSTEM AND METHOD FOR A DISTRIBUTED SENSING FLASHING BEACON FOR ALERTING VEHICLE DRIVERS

CROSS-REFERENCE TO RELATED APPLICATIONS

The present Utility patent application claims priority benefit of the U.S. provisional application for patent Ser. No. 62/761,093 entitled "Distributed Sensing Flashing Beacon (DSFB)", filed on Mar. 12, 2018 under 35 U.S.C. 119(e). The contents of this related provisional application are incorporated herein by reference for all purposes to the extent that such subject matter is not inconsistent herewith or limiting hereof.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

BACKGROUND OF THE RELEVANT PRIOR ART

One or more embodiments of the invention generally relate to a system and method for alerting vehicle drivers. More particularly, certain embodiments of the invention relate to a system and method for a distributed sensing flashing beacon for alerting vehicle drivers.

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon. Generally, vehicle drivers are alerted to certain traffic situations using beacon flashers. Typically the beacon flashers may fall into two categories, i.e., flashing continuously or flashing upon being triggered. For the flasher in the second category, a triggering sensor may be either embedded in a flasher housing or mounted near the flasher. Various studies have also indicated that the continuously flashing beacons do not necessarily attract driver's attention. In addition, they flash 24/7, day and night, even when there are no vehicles on the streets, which could introduce visual noises to the residents living nearby.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that solar-powered beacon flashers have been installed in many cities world over. They are typically used to alert vehicle drivers about the pedestrians, signages, or road conditions in the path ahead of the vehicle drivers. Some solar-powered beacon flashers are flashing continuously, 24/7, day and night, even when there are no vehicles or pedestrians nearby (shown in prior art FIG. 1). To avoid flashing constantly, motion sensors and video cameras have been used as the triggering sensors which have dual functionalities shown in Prior Art FIG. 2, i.e., (1) detection of vehicles or pedestrians, and (2) activation of flasher.

It is believed that the sensor triggering approach may have very short sensing range. Accordingly, to detect a fast-moving vehicle, it may be essential to detect them as early as possible in order to ensure that the vehicle drivers will have sufficient time to see the flashing beacons and slow down their vehicles accordingly. This may require a long sensing range, which is typically very difficult to do for any solar-powered sensors. For the sensors shown in FIG. 2, it may be possible to adjust the view of motion sensor or video camera to cover a long distance, which may result in achieving early detection for both vehicles and pedestrians. One can expect that the failure to provide accuracy in the long range sensing achieved in this manner may result in many false detections, resulting in the beacon essentially flashing continuously. A system for monitoring and controlling activation of a warning system available in the art may typically include a sensor module locally coupled to the warning system for sensing and controlling a flashing light of the warning system, a transceiver responsive to a microcontroller, and a power line interface for interfacing between the transceiver and the power line servicing the warning system. The sensor module may include a sensor arranged for sensing the flashing light, the microcontroller coupled to the sensor, and a power supply for providing power to the sensor module. Some other systems in the prior part may provide pedestrian crossing with presence detector and warning, including an independent and transportable constructive element that may be easy to assemble and dismantle. These systems may be equipped with presence detectors, warning devices, power supply system, accumulators and electronic devices (circuitry, etc.), which may detect pedestrians, vehicles, or both, in a crossing zone, and alert both drivers and pedestrians themselves, of their respective presence on said crossing, or in the proximity thereto, and provide greater road safety. Further, To avoid flashing constantly, motion sensors, video cameras and pushbuttons have been used as the triggering sensors, in which sensors are attached to the flashers. It is believed that, these existing triggering methods may have limited detection range because the detectors are next to the flashers.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
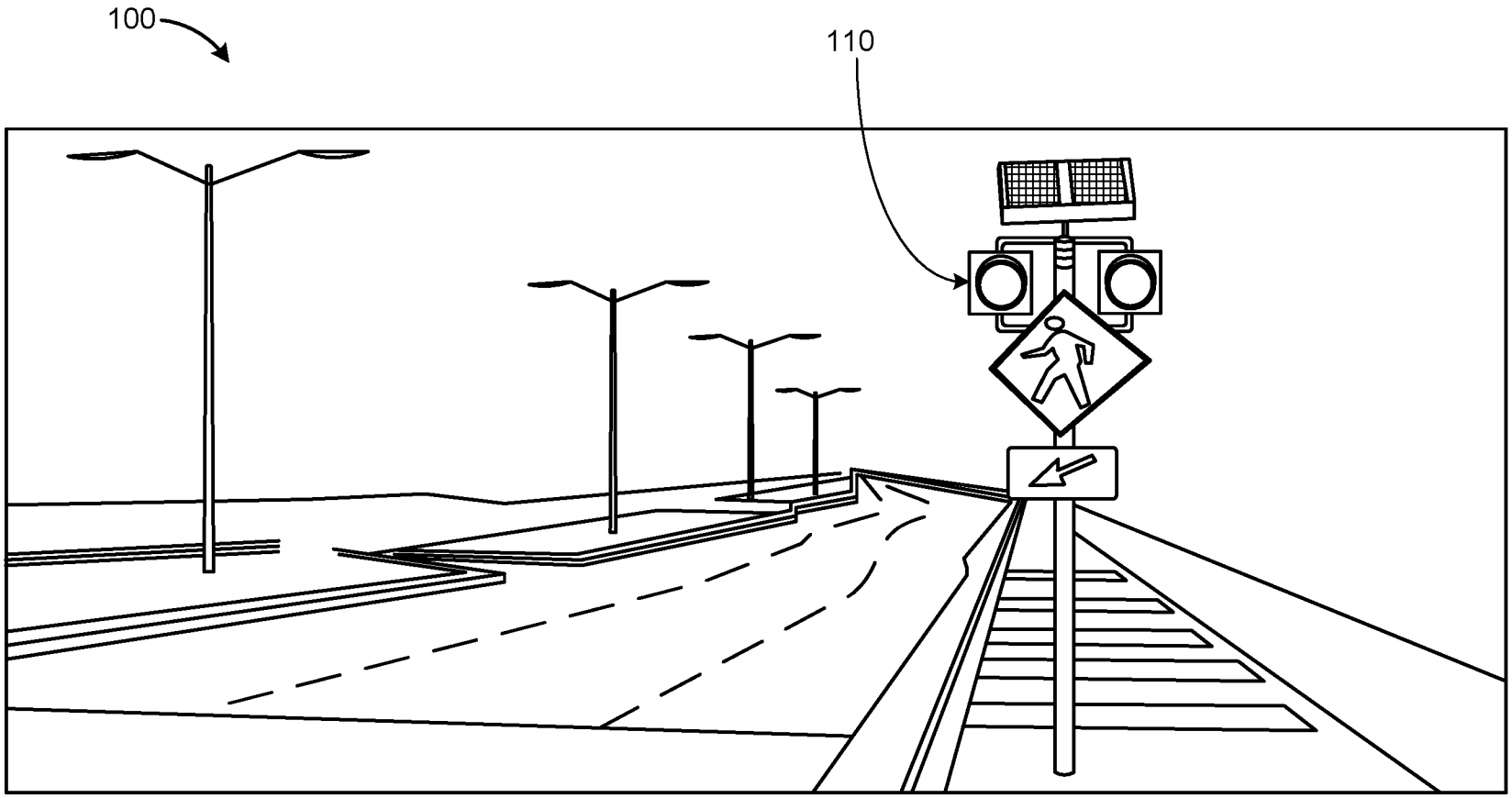
FIG. 1 PRIOR ART
FIG. 1 illustrates a prior art system for providing alerts to a vehicle driver.
Figure 2:
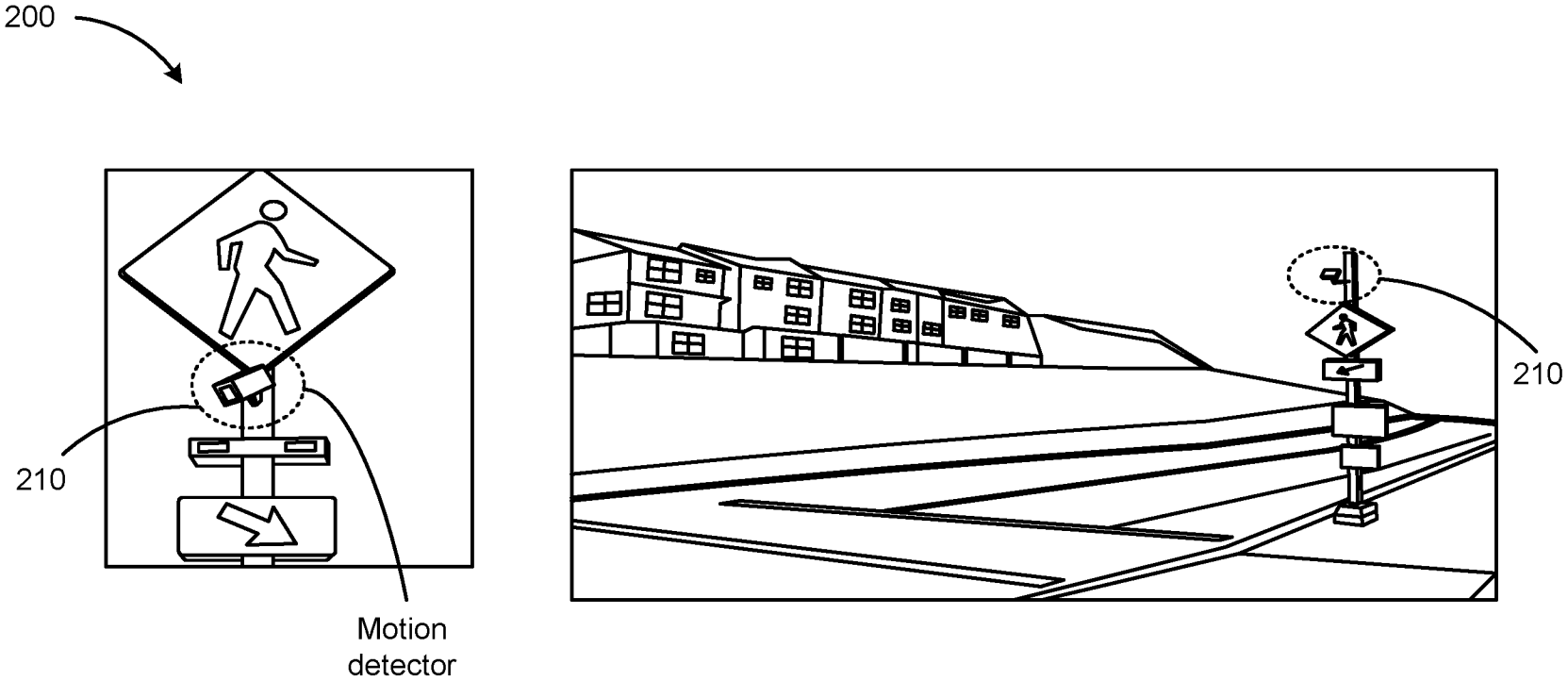
FIG. 2 PRIOR ART
FIG. 2 illustrates a prior art system for providing alerts to a vehicle driver.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, it is well settled law, as early as 1939, that words of approximation are not indefinite in the claims even when such limits are not defined or specified in the specification.

For example, see Ex parte Mallory, 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See Energy Absorption Sys., Inc. v. Roadway Safety Servs., Inc., Civ. App. 96-1264, slip op. at 10 (Fed. Cir. Jul. 3, 1997) (unpublished) Hybridtech v. Monoclonal Antibodies, Inc., 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See Seattle Box Co. v. Industrial Crating & Packing, Inc., 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. Deering Precision Instruments, L.L.C. v. Vector Distribution Sys., Inc., 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). (Fact 4). The ordinary meaning of "substantially halfway" is thus reasonably close to or nearly at the midpoint between the forwardmost point of the upper or outsole and the rearwardmost point of the upper or outsole.

Similarly, the term 'substantially' is well recognize in case law to have the dual ordinary meaning of connoting a term of approximation or a term of magnitude. See Dana Corp. v. American Axle & Manufacturing, Inc., Civ. App. 04-1116, 2004 U.S. App. LEXIS 18265, *13-14 (Fed. Cir. Aug. 27, 2004) (unpublished). The term "substantially" is commonly used by claim drafters to indicate approximation. See Cordis Corp. v. Medtronic AVE Inc., 339 F.3d 1352, 1360 (Fed. Cir. 2003) ("The patents do not set out any numerical standard by which to determine whether the thickness of the wall surface is 'substantially uniform.' The term 'substantially,' as used in this context, denotes approximation. Thus, the walls must be of largely or approximately uniform thickness."); see also Deering Precision Instruments, LLC v. Vector Distribution Sys., Inc., 347 F.3d 1314, 1322 (Fed. Cir. 2003); Epcon Gas Sys., Inc. v. Bauer Compressors, Inc., 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, Liquid Dynamics Corp. v. Vaughan Co., 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In Cordis Corp. v. Medtronic AVE, Inc., 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In Anchor Wall Systems v. Rockwood Retaining Walls, Inc., 340 F.3d 1298, 1311 (Fed. Cir. 2003)" Id. at 1311. Similarly, the plain language of Claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see Deering Precision Instruments, L.L.C. v. Vector Distrib. Sys., Inc., 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., Epcon Gas Sys., Inc. v. Bauer Compressors, Inc., 279 F.3d 1022 (Fed. Cir. 2002) (construing the terms "substantially constant" and "substantially below"); Zodiac Pool Care, Inc. v. Hoffinger Indus., Inc., 206 F.3d 1408 (Fed. Cir. 2000) (construing the term "substantially inward"); York Prods., Inc. v. Cent. Tractor Farm & Family Ctr., 99 F.3d 1568 (Fed. Cir. 1996) (construing the term "substantially the entire height thereof"); Tex. Instruments Inc. v. Cypress Semiconductor Corp., 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see AK Steel Corp. v. Sollac, 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by Pall Corp. v. Micron Separations, Inc., 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see Verve LLC v. Crane Cams Inc., 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. § 112, and indeed may be necessary in order to provide the inventor with the benefit of his invention. In Andrew Corp. v. Gabriel Elecs. Inc., 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in Ecolab Inc. v. Envirochem, Inc., 264 F.3d 1358, 1367, 60 USPQ2d 1173, 1179 (Fed. Cir. 2001) that "like the term 'about,' the term 'substantially' is a descriptive term commonly used in patent claims to 'avoid a strict numerical boundary to the specified parameter, see Ecolab Inc. v. Envirochem Inc., 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see Pall Corp. v. Micron Seps., 66 F.3d 1211, 1217, 36 USPQ2d 1225, 1229 (Fed. Cir. 1995); see, e.g., Andrew Corp. v. Gabriel Elecs. Inc., 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see Ex parte Mallory, 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will be described in detail below with reference to embodiments thereof as illustrated in the accompanying drawings.

References to a "device," an "apparatus," a "system," etc., in the preamble of a claim should be construed broadly to mean "any structure meeting the claim terms" exempt for any specific structure(s)/type(s) that has/(have) been explicitly disavowed or excluded or admitted/implied as prior art in the present specification or incapable of enabling an object/aspect/goal of the invention. Furthermore, where the present specification discloses an object, aspect, function, goal, result, or advantage of the invention that a specific prior art structure and/or method step is similarly capable of performing yet in a very different way, the present invention disclosure is intended to and shall also implicitly include and cover additional corresponding alternative embodiments that are otherwise identical to that explicitly disclosed except that they exclude such prior art structure(s)/step(s), and shall accordingly be deemed as providing sufficient disclosure to support a corresponding negative limitation in a claim claiming such alternative embodiment(s), which exclude such very different prior art structure(s)/step(s) way(s).

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" include the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, is generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of or interaction, with some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising." This term is open-ended. As used in the appended claims, this term does not foreclose additional structure or steps. Consider a claim that recites: "A memory controller comprising a system cache . . . ." Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. .sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" and "consisting of" limits the scope of a claim to the specified elements or method steps, plus those that do not materially affect the basis and novel characteristic(s) of the claimed subject matter (see Norian Corp. v Stryker Corp., 363 F.3d 1321, 1331-32, 70 USPQ2d 1508, Fed. Cir. 2004). Moreover, for any claim of the present invention which claims an embodiment "consisting essentially of" or "consisting of" a certain set of elements of any herein described embodiment it shall be understood as obvious by those skilled in the art that the present invention also covers all possible varying scope variants of any described embodiment(s) that are each exclusively (i.e., "consisting essentially of") functional subsets or functional combination thereof such that each of these plurality of exclusive varying scope variants each consists essentially of any functional subset(s) and/or functional combination(s) of any set of elements of any described embodiment(s) to the exclusion of any others not set forth therein. That is, it is contemplated that it will be obvious to those skilled how to create a multiplicity of alternate embodiments of the present invention that simply consisting essentially of a certain functional combination of elements of any described embodiment(s) to the exclusion of any others not set forth therein, and the invention thus covers all such exclusive embodiments as if they were each described herein.

With respect to the terms "comprising," "consisting of," and "consisting essentially of," where one of these three terms is used herein, the disclosed and claimed subject matter may include the use of either of the other two terms. Thus in some embodiments not otherwise explicitly recited, any instance of "comprising" may be replaced by "consisting of" or, alternatively, by "consisting essentially of", and thus, for the purposes of claim support and construction for "consisting of" format claims, such replacements operate to create yet other alternative embodiments "consisting essentially of" only the elements recited in the original "comprising" embodiment to the exclusion of all other elements.

Moreover, any claim limitation phrased in functional limitation terms covered by 35 USC § 112(6) (post AIA 112(f)) which has a preamble invoking the closed terms "consisting of," or "consisting essentially of," should be understood to mean that the corresponding structure(s) disclosed herein define the exact metes and bounds of what the so claimed invention embodiment(s) consists of, or consisting essentially of, to the exclusion of any other elements which do not materially affect the intended purpose of the so claimed embodiment(s).

Devices or system modules that are in at least general communication with each other need not be in continuous communication with each other, unless expressly specified otherwise. In addition, devices or system modules that are in at least general communication with each other may communicate directly or indirectly through one or more intermediaries. Moreover, it is understood that any system components described or named in any embodiment or claimed herein may be grouped or sub-grouped (and accordingly implicitly renamed) in any combination or sub-combination as those skilled in the art can imagine as suitable for the particular application, and still be within the scope and spirit of the claimed embodiments of the present invention. For an example of what this means, if the invention was a controller of a motor and a valve and the embodiments and claims articulated those components as being separately grouped and connected, applying the foregoing would mean that such an invention and claims would also implicitly cover the valve being grouped inside the motor and the controller being a remote controller with no direct physical connection to the motor or internalized valve, as such the claimed invention is contemplated to cover all ways of grouping and/or adding of intermediate components or systems that still substantially achieve the intended result of the invention.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

A "computer" may refer to one or more apparatus and/or one or more systems that are capable of accepting a structured input, processing the structured input according to prescribed rules, and producing results of the processing as output. Examples of a computer may include: a computer; a stationary and/or portable computer; a computer having a single processor, multiple processors, or multi-core processors, which may operate in parallel and/or not in parallel; a general purpose computer; a supercomputer; a mainframe; a super mini-computer; a mini-computer; a workstation; a micro-computer; a server; a client; an interactive television; a web appliance; a telecommunications device with internet access; a hybrid combination of a computer and an interactive television; a portable computer; a tablet personal computer (PC); a personal digital assistant (PDA); a portable telephone; application-specific hardware to emulate a computer and/or software, such as, for example, a digital signal processor (DSP), a field-programmable gate array (FPGA), an application specific integrated circuit (ASIC), an application specific instruction-set processor (ASIP), a chip, chips, a system on a chip, or a chip set; a data acquisition device; an optical computer; a quantum computer; a biological computer; and generally, an apparatus that may accept data, process data according to one or more stored software programs, generate results, and typically include input, output, storage, arithmetic, logic, and control units.

Those of skill in the art will appreciate that where appropriate, some embodiments of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Where appropriate, embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

"Software" may refer to prescribed rules to operate a computer. Examples of software may include: code segments in one or more computer-readable languages; graphical and or/textual instructions; applets; pre-compiled code; interpreted code; compiled code; and computer programs.

The example embodiments described herein can be implemented in an operating environment comprising computer-executable instructions (e.g., software) installed on a computer, in hardware, or in a combination of software and hardware. The computer-executable instructions can be written in a computer programming language or can be embodied in firmware logic. If written in a programming language conforming to a recognized standard, such instructions can be executed on a variety of hardware platforms and for interfaces to a variety of operating systems. Although not limited thereto, computer software program code for carrying out operations for aspects of the present invention can be written in any combination of one or more suitable programming languages, including an object oriented programming languages and/or conventional procedural programming languages, and/or programming languages such as, for example, Hyper text Markup Language (HTML), Dynamic HTML, Extensible Markup Language (XML), Extensible Stylesheet Language (XSL), Document Style Semantics and Specification Language (DSSSL), Cascading Style Sheets (CSS), Synchronized Multimedia Integration Language (SMIL), Wireless Markup Language (WML), Java™, Jini™, C, C++, Smalltalk, Perl, UNIX Shell, Visual Basic or Visual Basic Script, Virtual Reality Markup Language (VRML), ColdFusion™ or other compilers, assemblers, interpreters or other computer languages or platforms.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

A network is a collection of links and nodes (e.g., multiple computers and/or other devices connected together) arranged so that information may be passed from one part of the network to another over multiple links and through various nodes. Examples of networks include the Internet, the public switched telephone network, the global Telex network, computer networks (e.g., an intranet, an extranet, a local-area network, or a wide-area network), wired networks, and wireless networks.

The Internet is a worldwide network of computers and computer networks arranged to allow the easy and robust exchange of information between computer users. Hundreds of millions of people around the world have access to computers connected to the Internet via Internet Service Providers (ISPs). Content providers (e.g., website owners or operators) place multimedia information (e.g., text, graphics, audio, video, animation, and other forms of data) at specific locations on the Internet referred to as webpages. Websites comprise a collection of connected, or otherwise related, webpages. The combination of all the websites and their corresponding webpages on the Internet is generally known as the World Wide Web (WWW) or simply the Web.

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

The flowchart and block diagrams in the figures illustrate the architecture, functionality, and operation of possible implementations of systems, methods and computer program products according to various embodiments. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

Further, although process steps, method steps, algorithms or the like may be described in a sequential order, such processes, methods and algorithms may be configured to work in alternate orders. In other words, any sequence or order of steps that may be described does not necessarily indicate a requirement that the steps be performed in that order. The steps of processes described herein may be performed in any order practical. Further, some steps may be performed simultaneously.

It will be readily apparent that the various methods and algorithms described herein may be implemented by, e.g., appropriately programmed general purpose computers and computing devices. Typically a processor (e.g., a microprocessor) will receive instructions from a memory or like device, and execute those instructions, thereby performing a process defined by those instructions. Further, programs that implement such methods and algorithms may be stored and transmitted using a variety of known media.

When a single device or article is described herein, it will be readily apparent that more than one device/article (whether or not they cooperate) may be used in place of a single device/article. Similarly, where more than one device or article is described herein (whether or not they cooperate), it will be readily apparent that a single device/article may be used in place of the more than one device or article.

The functionality and/or the features of a device may be alternatively embodied by one or more other devices which are not explicitly described as having such functionality/features. Thus, other embodiments of the present invention need not include the device itself.

The term "computer-readable medium" as used herein refers to any medium that participates in providing data (e.g., instructions) which may be read by a computer, a processor or a like device. Such a medium may take many forms, including but not limited to, non-volatile media, volatile media, and transmission media. Non-volatile media include, for example, optical or magnetic disks and other persistent memory. Volatile media include dynamic random access memory (DRAM), which typically constitutes the main memory. Transmission media include coaxial cables, copper wire and fiber optics, including the wires that comprise a system bus coupled to the processor. Transmission media may include or convey acoustic waves, light waves and electromagnetic emissions, such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, removable media, flash memory, a "memory stick", any other memory chip or cartridge, a carrier wave as described hereinafter, or any other medium from which a computer can read.

Various forms of computer readable media may be involved in carrying sequences of instructions to a processor. For example, sequences of instruction (i) may be delivered from RAM to a processor, (ii) may be carried over a wireless transmission medium, and/or (iii) may be formatted according to numerous formats, standards or protocols, such as Bluetooth, TDMA, CDMA, 3G.

Where databases are described, it will be understood by one of ordinary skill in the art that (i) alternative database structures to those described may be readily employed, (ii) other memory structures besides databases may be readily employed. Any schematic illustrations and accompanying descriptions of any sample databases presented herein are exemplary arrangements for stored representations of information. Any number of other arrangements may be employed besides those suggested by the tables shown. Similarly, any illustrated entries of the databases represent exemplary information only; those skilled in the art will understand that the number and content of the entries can be different from those illustrated herein. Further, despite any depiction of the databases as tables, an object-based model could be used to store and manipulate the data types of the present invention and likewise, object methods or behaviors can be used to implement the processes of the present invention.

A "computer system" may refer to a system having one or more computers, where each computer may include a computer-readable medium embodying software to operate the computer or one or more of its components. Examples of a computer system may include: a distributed computer system for processing information via computer systems linked by a network; two or more computer systems connected together via a network for transmitting and/or receiving information between the computer systems; a computer system including two or more processors within a single computer; and one or more apparatuses and/or one or more systems that may accept data, may process data in accordance with one or more stored software programs, may generate results, and typically may include input, output, storage, arithmetic, logic, and control units.

A "network" may refer to a number of computers and associated devices that may be connected by communication facilities. A network may involve permanent connections such as cables or temporary connections such as those made through telephone or other communication links. A network may further include hard-wired connections (e.g., coaxial cable, twisted pair, optical fiber, waveguides, etc.) and/or wireless connections (e.g., radio frequency waveforms, free-space optical waveforms, acoustic waveforms, etc.). Examples of a network may include: an internet, such as the Internet; an intranet; a local area network (LAN); a wide area network (WAN); and a combination of networks, such as an internet and an intranet.

As used herein, the "client-side" application should be broadly construed to refer to an application, a page associated with that application, or some other resource or function invoked by a client-side request to the application. A "browser" as used herein is not intended to refer to any specific browser (e.g., Internet Explorer, Safari, FireFox, or the like), but should be broadly construed to refer to any client-side rendering engine that can access and display Internet-accessible resources. A "rich" client typically refers to a non-HTTP based client-side application, such as an SSH or CFIS client. Further, while typically the client-server interactions occur using HTTP, this is not a limitation either. The client server interaction may be formatted to conform to the Simple Object Access Protocol (SOAP) and travel over HTTP (over the public Internet), FTP, or any other reliable transport mechanism (such as IBM® MQSeries® technologies and CORBA, for transport over an enterprise intranet) may be used. Any application or functionality described herein may be implemented as native code, by providing hooks into another application, by facilitating use of the mechanism as a plug-in, by linking to the mechanism, and the like.

Exemplary networks may operate with any of a number of protocols, such as Internet protocol (IP), asynchronous transfer mode (ATM), and/or synchronous optical network (SONET), user datagram protocol (UDP), IEEE 802.x, etc.

Embodiments of the present invention may include apparatuses for performing the operations disclosed herein. An apparatus may be specially constructed for the desired purposes, or it may comprise a general-purpose device selectively activated or reconfigured by a program stored in the device.

Embodiments of the invention may also be implemented in one or a combination of hardware, firmware, and software. They may be implemented as instructions stored on a machine-readable medium, which may be read and executed by a computing platform to perform the operations described herein.

More specifically, as will be appreciated by one skilled in the art, aspects of the present invention may be embodied as a system, method or computer program product. Accordingly, aspects of the present invention may take the form of an entirely hardware embodiment, an entirely software embodiment (including firmware, resident software, microcode, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

In the following description and claims, the terms "computer program medium" and "computer readable medium" may be used to generally refer to media such as, but not limited to, removable storage drives, a hard disk installed in hard disk drive, and the like. These computer program products may provide software to a computer system. Embodiments of the invention may be directed to such computer program products.

An algorithm is here, and generally, considered to be a self-consistent sequence of acts or operations leading to a desired result. These include physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like. It should be understood, however, that all of these and similar terms are to be associated with the appropriate physical quantities and are merely convenient labels applied to these quantities.

Unless specifically stated otherwise, and as may be apparent from the following description and claims, it should be appreciated that throughout the specification descriptions utilizing terms such as "processing," "computing," "calculating," "determining," or the like, refer to the action and/or processes of a computer or computing system, or similar electronic computing device, that manipulate and/or transform data represented as physical, such as electronic, quantities within the computing system's registers and/or memories into other data similarly represented as physical quantities within the computing system's memories, registers or other such information storage, transmission or display devices.

Additionally, the phrase "configured to" or "operable for" can include generic structure (e.g., generic circuitry) that is manipulated by software and/or firmware (e.g., an FPGA or a general-purpose processor executing software) to operate in a manner that is capable of performing the task(s) at issue. "Configured to" may also include adapting a manufacturing process (e.g., a semiconductor fabrication facility) to fabricate devices (e.g., integrated circuits) that are adapted to implement or perform one or more tasks.

In a similar manner, the term "processor" may refer to any device or portion of a device that processes electronic data from registers and/or memory to transform that electronic data into other electronic data that may be stored in registers and/or memory. A "computing platform" may comprise one or more processors.

Embodiments within the scope of the present disclosure may also include tangible and/or non-transitory computer-readable storage media for carrying or having computer-executable instructions or data structures stored thereon. Such non-transitory computer-readable storage media can be any available media that can be accessed by a general purpose or special purpose computer, including the functional design of any special purpose processor as discussed above. By way of example, and not limitation, such non-transitory computer-readable media can include RAM, ROM, EEPROM, CD-ROM or other optical disk storage, magnetic disk storage or other magnetic storage devices, or any other medium which can be used to carry or store desired program code means in the form of computer-executable instructions, data structures, or processor chip design. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

While a non-transitory computer readable medium includes, but is not limited to, a hard drive, compact disc, flash memory, volatile memory, random access memory, magnetic memory, optical memory, semiconductor based memory, phase change memory, optical memory, periodically refreshed memory, and the like; the non-transitory computer readable medium, however, does not include a pure transitory signal per se; i.e., where the medium itself is transitory.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

Embodiments of the invention disclosed herein integrate a low-power wireless receiver into a flasher housing and power the receiver using solar power. The flasher housing may also include a control panel to turn on/off LED (light emitting diode) lights based on detection of moving objects, including but not limited to, pedestrians, vehicles, bicyclists, and the like. The system may also include a solar panel(s) connected to a battery-powered wireless sensor. In one embodiment, the detection system disclosed herein may have a long wireless communication range of about 1,500 feet solving the prior art issue of wired sensor triggering devices having a short sensing range. In one embodiment, the detection system disclosed herein may include multiple sensors can turn on/off a single flasher wirelessly solving the prior art issue of multiple solar sensors not being able to turn on/off the same solar-powered flasher simultaneously, thus preventing them from being distributed remotely and spatially.

In one embodiment, the present invention provides a system and method for providing a wireless communication for activating solar powered flashing beacons and/or solar powered flashing signs (i.e., solar powered flashers) based on the presence of vehicles and pedestrians which could be close to flashers or far away from flashers. In one exemplary embodiment, the sensing device, i.e., a detector and the receiving device, i.e., a flasher may be detached from each other. In this exemplary embodiment, there may be no physical connection i.e., no wired connecting between them. In one embodiment, the flasher and a sensor receiver may be physically integrated inside a flasher housing through a set of relay devices. In one exemplary embodiment, flasher and sensor receiver inside the flasher housing through a set of relay devices multiple detectors may be strategically placed at various physical locations and may be capable of activating the same flasher wirelessly. In an exemplary embodiment, multiple detectors may be configured to detect targets such as, without limitation, vehicles moving in different directions and activate the same flasher wirelessly. In an exemplary embodiment, multiple detectors may be configured to detect a single target appearing at different locations over a short period of time, and a timing sequence may be used to activate flashers specific to applications such as, without limitation, "driving in wrong direction". In an exemplary embodiment, different solar panels may be mounted on the same flasher and individual ones may be aimed at different directions to maximize the battery charging time. In an exemplary embodiment, relay devices may be used to configure the flashing time interval once the vehicles and/or pedestrians are detected. In an exemplary embodiment, different relay devices may be used to configure the flashing interval and flashing patterns based on different detectors placed at different locations for the vehicle detections or pedestrian detections. In one exemplary embodiment, a timer may be integrated in the system. Using this timer and a set of relay devices, flasher may be turned on and flash in different patterns based on time intervals.

In various embodiments, based on required application of the system and method described herein, the same flasher may be configured to flash continuously or flash based on the detection of vehicles and pedestrians.

Accordingly, in one embodiment, is provided a system for alerting vehicle drivers. In one exemplary embodiment, the system may include (i) a solar powered flasher (at times referred to as beacon) in working communication with a wireless receiver, and (ii) multiple solar powered detectors in working communication with wireless senders. It will be appreciated by a person with ordinary skill in the art, in light of and in accordance with the teachings of the present invention, that the system may include any suitable solar powered flasher and solar powered detector which may be capable of communicate wirelessly over a short range or a long range. In an exemplary embodiment, the system disclosed herein may be intended for outdoor application under any weather conditions.

Figure 3:
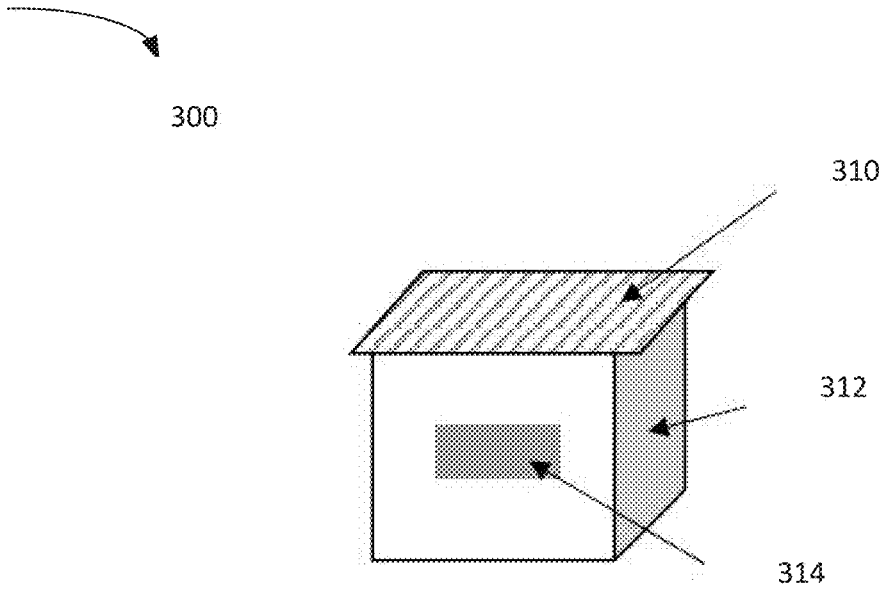
FIG. 3 illustrates exemplary sensing devices for providing alerts to a vehicle driver, in accordance with an embodiment of the present invention.
Figure 3:
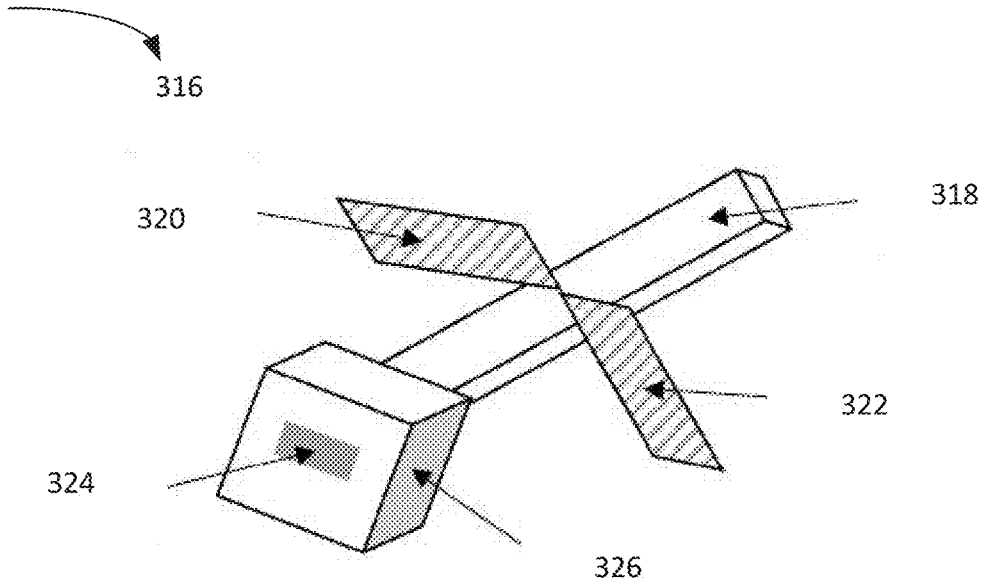

FIG. 3 illustrates exemplary sensing devices 300, 316, in accordance with an embodiment of the present invention. The sensing device 300, illustrates a solar panel 310, a detector 312 and a detector window 314. The sensing device 316 illustrates a mounting bracket 318. Solar panels 320 and 322 and the detector 326 with the detector window 324 may be mounted on the mounting bracket 318. In one embodiment, the sensing device 316 is used in the system and method described herein for alerting vehicle drivers. In some other embodiments, both sensing device 300 and modified sensing device 316 may be employed.

Figure 4:
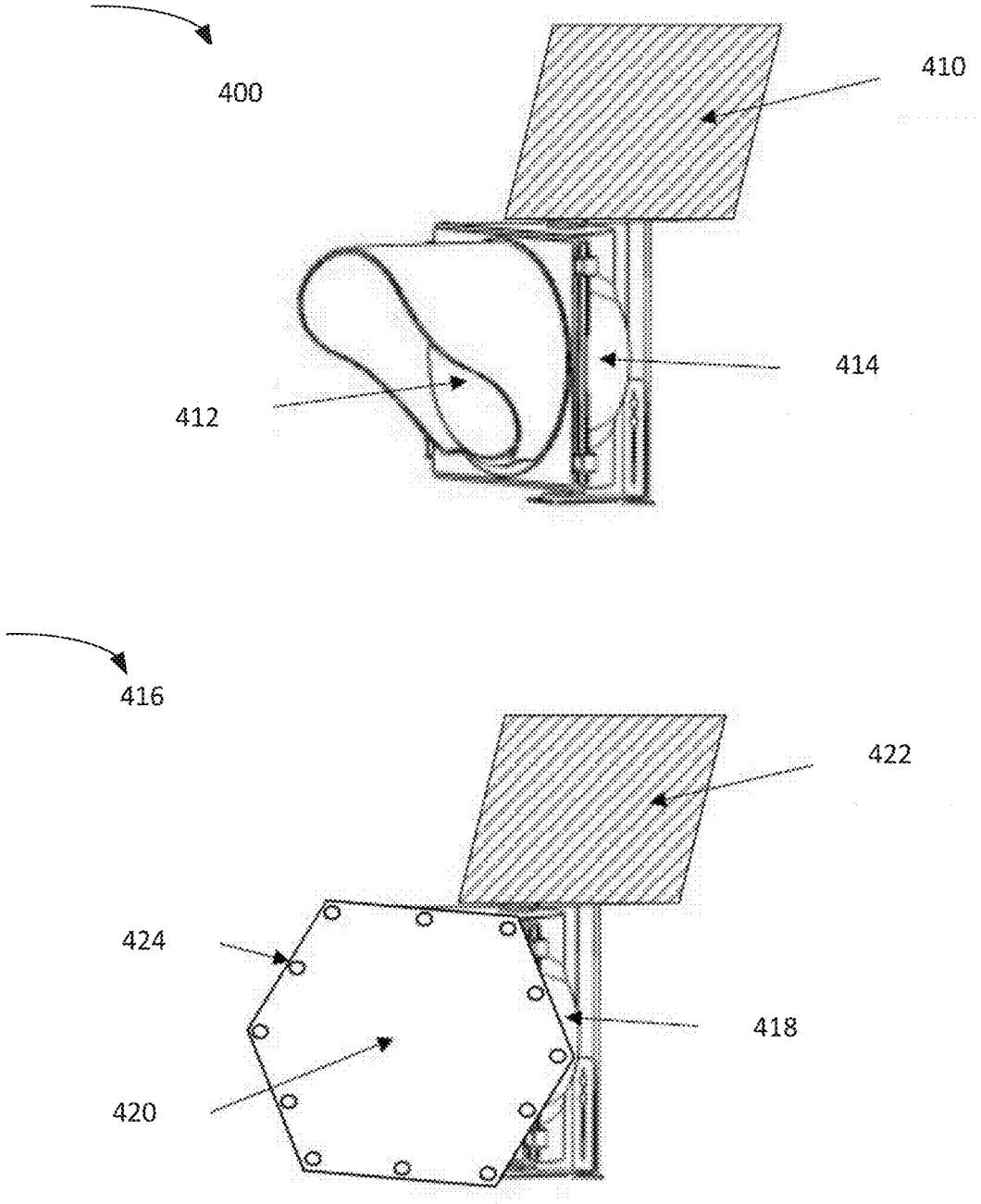
FIG. 4 illustrates exemplary flashers for providing alerts to a vehicle driver, in accordance with an embodiment of the present invention.

FIG. 4 illustrates exemplary flashers 400, 416, in accordance with an embodiment of the present invention. The flasher 400, illustrates a solar panel 410, a flasher 412 (i.e., a flashing beacon) and a battery housing 414. The flasher 416 illustrates a solar panel 422, a battery housing 418, a flasher 420 (i.e., a flashing sign or traffic sign) and LED 424.

Figure 5:
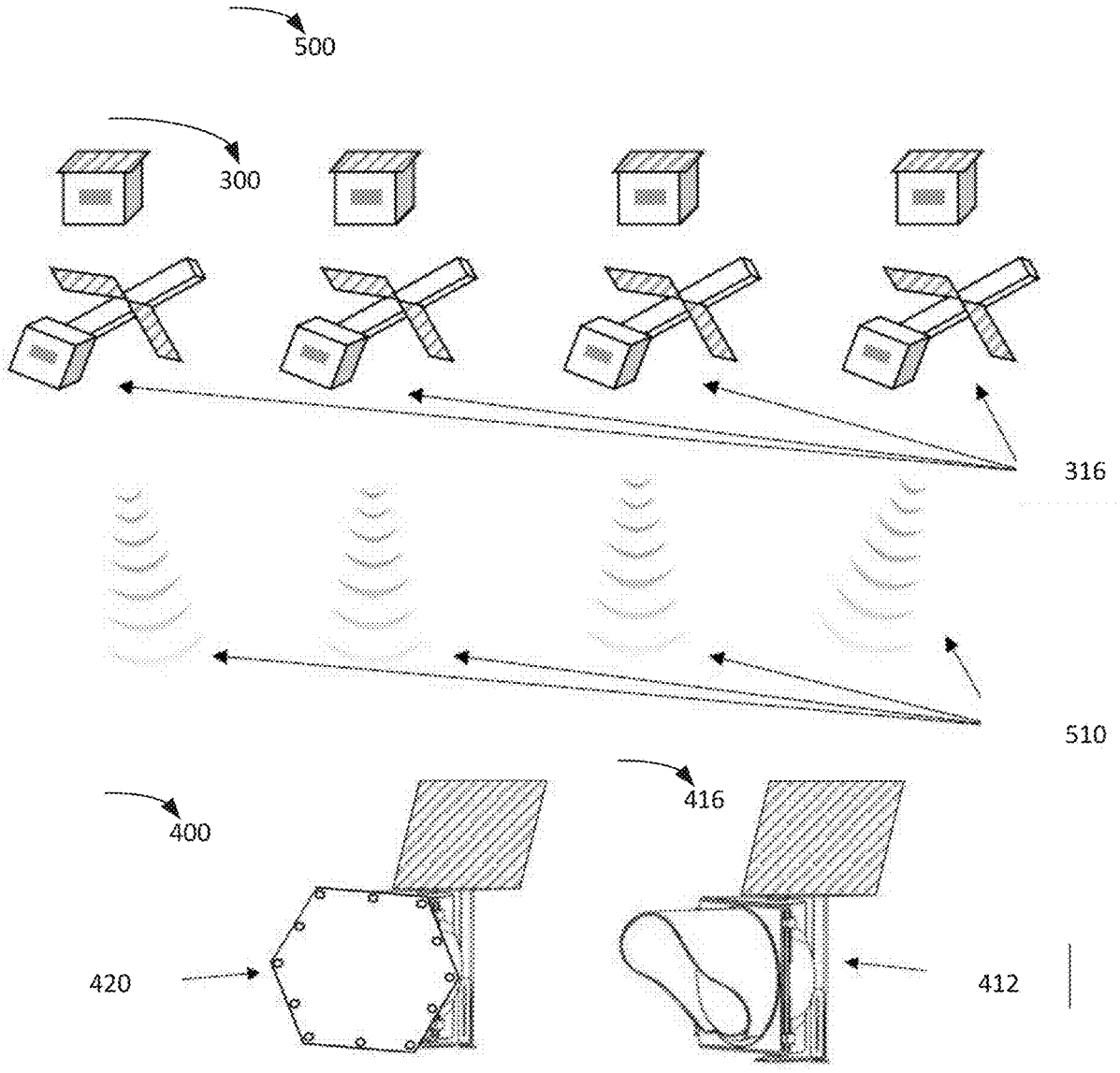
FIG. 5 illustrates an exemplary method of wireless communications of the sensing devices and flashers for providing alerts to a vehicle driver, in accordance with an embodiment of the present invention.

FIG. 5 illustrates an exemplary method 500 of wireless communications of the sensing devices (detectors) and flashers, in accordance with an embodiment of the present invention. As shown in FIG. 5, multiple sensing devices (detectors) 300, 316 are in wireless working communication 510 with a single flasher 400, 416 or multiple flashers 400 and 416.

It will be appreciated by a person with ordinary skill in the art, in light of and in accordance with the teachings of the present invention, that the various components in the system may be sourced from various sources, may be made of any suitable material, in any suitable shape and size, and the like as per the application. In exemplary embodiments:

Component 1 i.e., the solar beacon with battery and solar panel 400 may include a control panel with a wireless receiver, relay and timer into the battery housing 414.

Component 2: wireless receiver may in exemplary embodiment include four wireless channels. A voltage signal may be extracted from the channel used to detect the signal. Two separate wires of 12 Volts may also be connected to a power button and a momentary voltage pulse injected to the power button to switch-ON the wireless receiver when the system is powered up.

Component 3: wireless detector 300 in an exemplary embodiment, may include its own solar panel which may be suitable for limited number of detections per day. To support frequent detections on roadways, another solar panel may be added to increase the charging rate of its battery, as shown in 316.

Component 4: relay without timer (not shown in figures) can take a low voltage from the wireless receiver and convert it to a standard 5V output.

Component 5: relay with timer (not shown in figures) can take a 5V input signal and open/close the connection to the flasher LEDs. It can also be programmed to flash LEDs in various patterns over a period of time.

Component 6: timer can be programmed to turn on/off the system at certain time instances.

Component 7: solar panel 320, 322 for detector 326 can be attached to the detector through a mounting bracket 318. It can increase the battery charging rate.

In an exemplary embodiment, the system and method disclosed herein are advantageous in that the entire system may consume less power so that the solar panel and the solar battery may be of smaller sizes and may be capable of fitting in a limited space. Accordingly, the present invention provides low-power electronic circuits to retrieve wireless signal from a detector and actuate the flasher. In an exemplary embodiment, the system and method of present invention may extract the voltage signals from the wireless receiver and amplify them to be suitable for a subsequent relay device without a microprocessor. In one exemplary embodiment, to reset the wireless receiver periodically, a timer may also be added to switch OFF/ON the system at midnight each day. The timer and relay may be connected to generate a voltage pulse to turn on the receiver itself. Accordingly, the system disclosed herein employs a minimum number of electronic components to ensure a low power consumption of the entire system.

Figure 6:
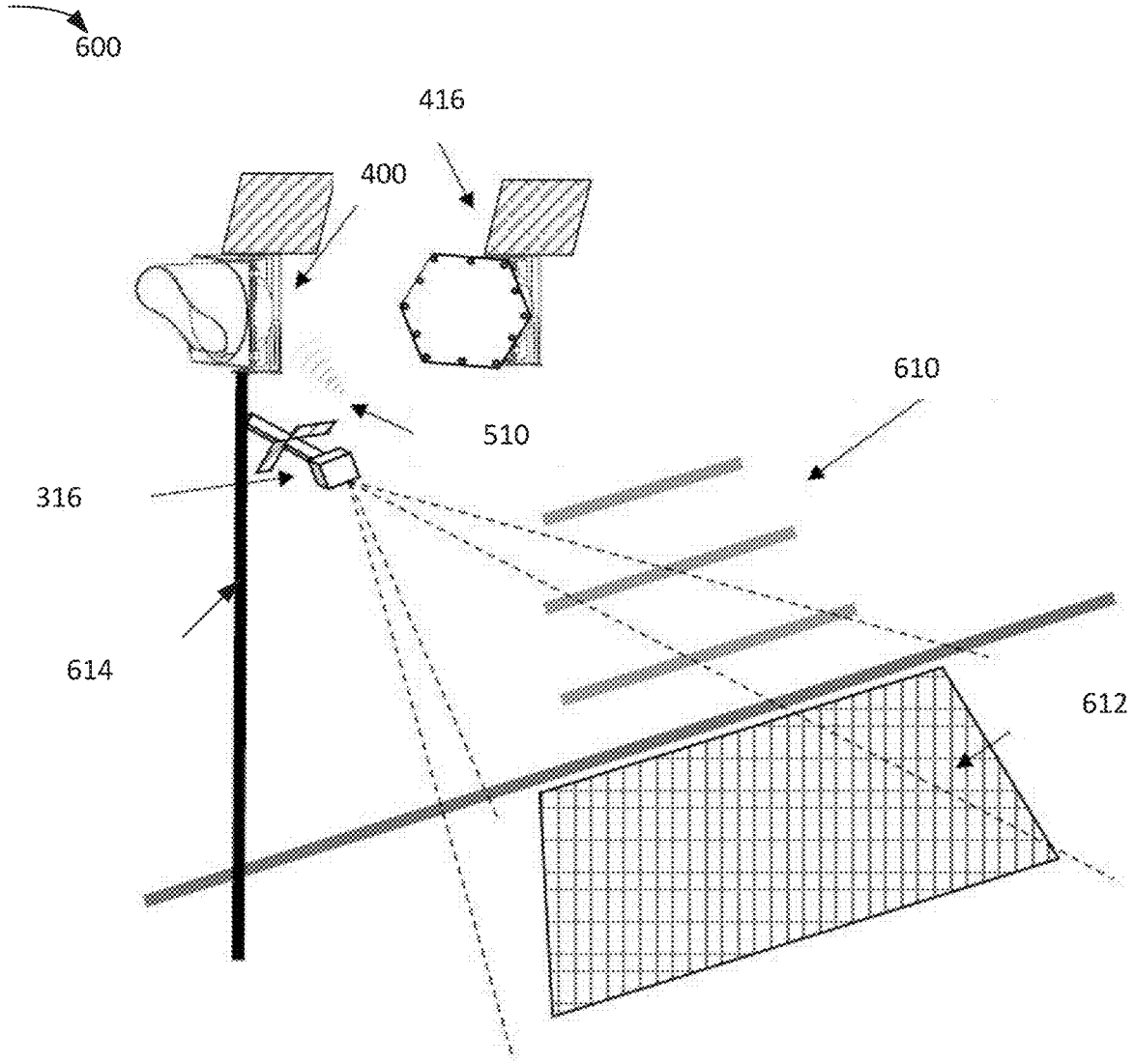
FIG. 6 illustrates an exemplary method of pedestrian activated wireless communications of the sensing devices and flashers for providing alerts to a vehicle driver, in accordance with an embodiment of the present invention.

FIG. 6 illustrates an exemplary method of pedestrian activated wireless communications of the sensing devices and flashers, in accordance with an embodiment of the present invention. In an exemplary embodiment, a method 600 for providing/installing a system for alerting drivers is provided. This system may also at times be referred to as a pedestrian safety system. For example, a pedestrian safety system is to be installed in front of a crosswalk near a school for the purpose of alerting vehicle drivers if students want to go across the crosswalk. In one embodiment, there may be no AC power available at the site and solar may be the only power source. In a first step, a solar beacon flasher with solar battery inside and solar panel on top may be assembled, i.e., 400, 416 as shown in FIG. 4. In a second step, a solar-powered wireless motion sensor and a battery-powered wireless receiver may be provided, i.e., 300 as shown in FIG. 3. In a third step the solar panel(s) 320, 322 may be connected to the battery-powered wireless receiver and the solar panel may be attached to a mounting bracket, 318 to provide an additional solar power reinforced detector 316. In a fourth step, an electronic control panel (not shown in figure) may be provided in the flasher 400, 416. The electronic control panel may receive detection signals from the battery-powered wireless receiver and turn on/off flasher through relay devices with timer function. In a fifth step, the battery-powered wireless receiver may be connected to the electronic control panel to send signal to the relay when it receives the detection signal from the sensing device. In a sixth step, the electronic control panel may be connected to the flasher that may be turned on when the receiver receives a wireless detection signal 510 from the sensing device. In a seventh step, at the crosswalk near the school, solar beacon flasher may be mounted on top of the sign post 614 and the solar panel angle may be adjusted. In a step 8, the sensing device may be mounted on the same post and the sensing device may be aimed at the waiting area 612 of the crosswalk 610. In a step 9, a start-switch (not shown in figure) may be switched-ON to make the system operational. For example, the system and method illustrated in FIG. 6 may be employed in as a flasher at a pedestrian crossing. At one side of crosswalk, one flasher with a solar panel is mounted on a sign post or pole. A solar detector is mounted on the same or different post or pole. The solar detector may be adjusted to ensure that vehicles on the road may not be detected. Install another flasher and detector at the other side of crosswalk. Now when a pedestrian walks into the curb, two flashers at both sides of the crosswalk may start flashing to alert the vehicle drivers.

Figure 7:
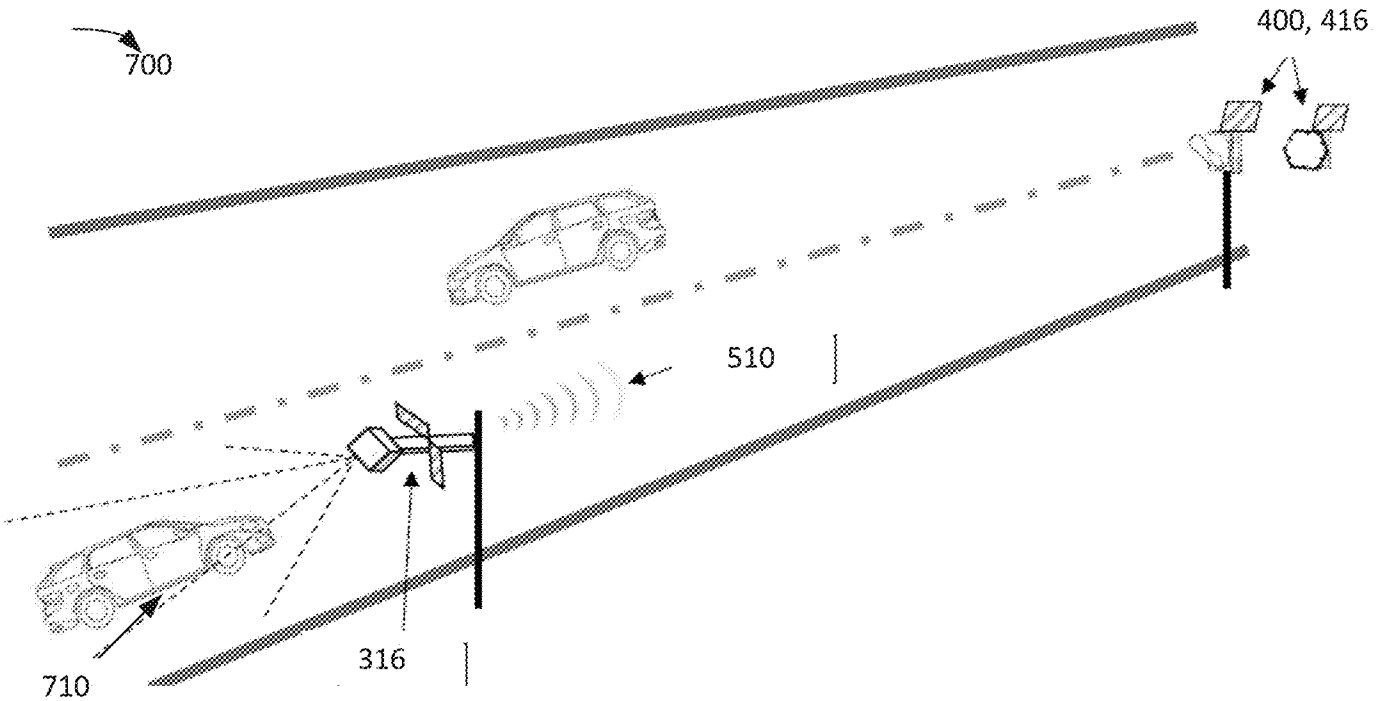
FIG. 7 illustrates an exemplary method of vehicle activated wireless communications of the sensing devices and flashers for providing alerts to a vehicle driver, in accordance with an embodiment of the present invention.

FIG. 7 illustrates an exemplary method of vehicle activated wireless communications of the sensing devices and flashers, in accordance with an embodiment of the present invention; In an exemplary embodiment, a method 700 for providing/installing a system for alerting drivers is provided. For example, a safety system is to be installed to detect a vehicle moving in a wrong direction at ab exit ramp leaving a highway. In a first step, three sensing devices 316 may be installed spaced at certain locations and distances from one another as suitable for the particular application to detect the type of dangerous or unauthorized motion of interest; for example, without limitation, at a periodic distance of 50 ft where one detector may be placed at entrance of wrong exit, second one placed about 50 ft from the entrance, and third one about 50 ft from the second one. Install a flasher at the beginning of the exit ramp. When a vehicle entering into the exit ramp 710, the three sensing devices 316 will detect it three times with three different timestamps. The detection signals may be sent wirelessly to the same flasher 416 in which an electronic device will determine if this vehicle is going in a wrong direction. If so, this device will switch-ON the flasher to let the vehicle driver know that he or she is driving in a wrong direction.

In another example, without limitation, the system and method disclosed herein may be employed as an indicator of a particular road structure by employing a flasher at a road structure. In this example, without limitation, one flasher may be installed on a sign post with a traffic sign indicating a road structure such as, without limitation, sharp-turn. Another location along the same road may be chosen, at about 300 or 400 feet from the flasher. The detector may be mounted on a post at this location. The detector view may be adjusted to avoid detecting vehicles going on the opposite lane(s). Now when an approaching vehicle is detected, the flasher starts flashing to alert the vehicle driver.

In another example, without limitation, the system and method disclosed herein may be employed as an indicator of a particular road structure by employing the system for detecting vehicles in different directions. At a street intersection, a flasher may be installed at the end of a crosswalk where pedestrians will go across. A detector may be installed at the adjust street where vehicles can make right-turn to enter the crosswalk. A second detector may be installed at the street where vehicles can enter into the crosswalk in normal traffic flow (through traffic). A third detector may be installed at the crosswalk median to detect a left-turn vehicle. Now when the pedestrian is walking through the crosswalk, vehicles from three directions can be detected and the flasher may be flashing to alert the pedestrian about the approaching vehicles.

Figure 8:
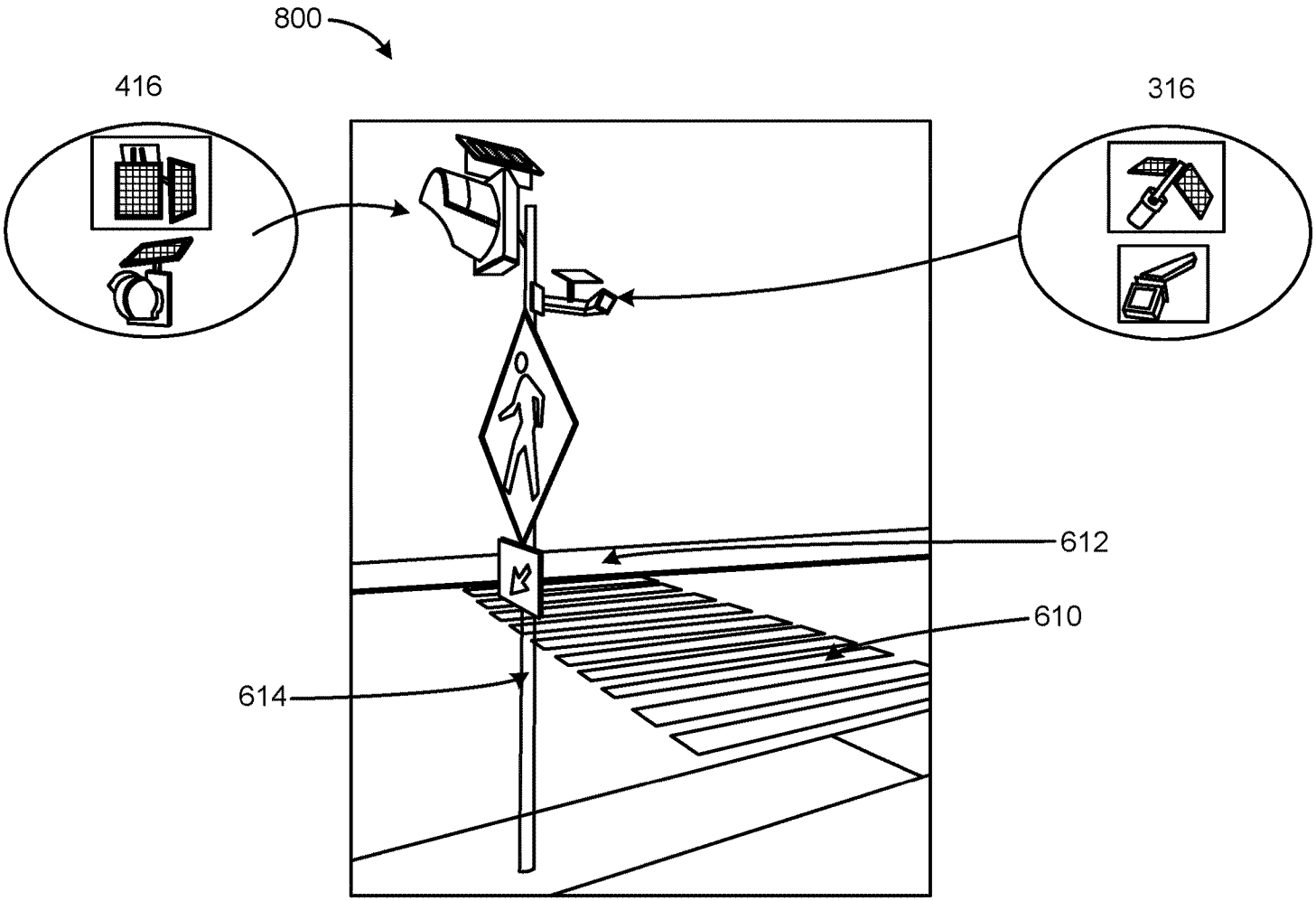
FIG. 8 illustrates a pictorial view of an exemplary method of pedestrian activated wireless communications of the sensing devices and flashers for providing alerts to a vehicle driver, in accordance with an embodiment of the present invention.

FIG. 8 illustrates a pictorial view 800 of an exemplary method of pedestrian activated wireless communications of the sensing devices and flashers for providing alerts to a vehicle driver, in accordance with an embodiment of the present invention. As shown in FIG. 8, a flasher 400, 416 is located on a pole 614. A detector 316 is located on a building near the road and may be focused on a waiting area 612 of the cross walk 610 to prevent on minimize pedestrian accident by alerting a vehicle driver approaching that pedestrian crossing.

Figure 9:
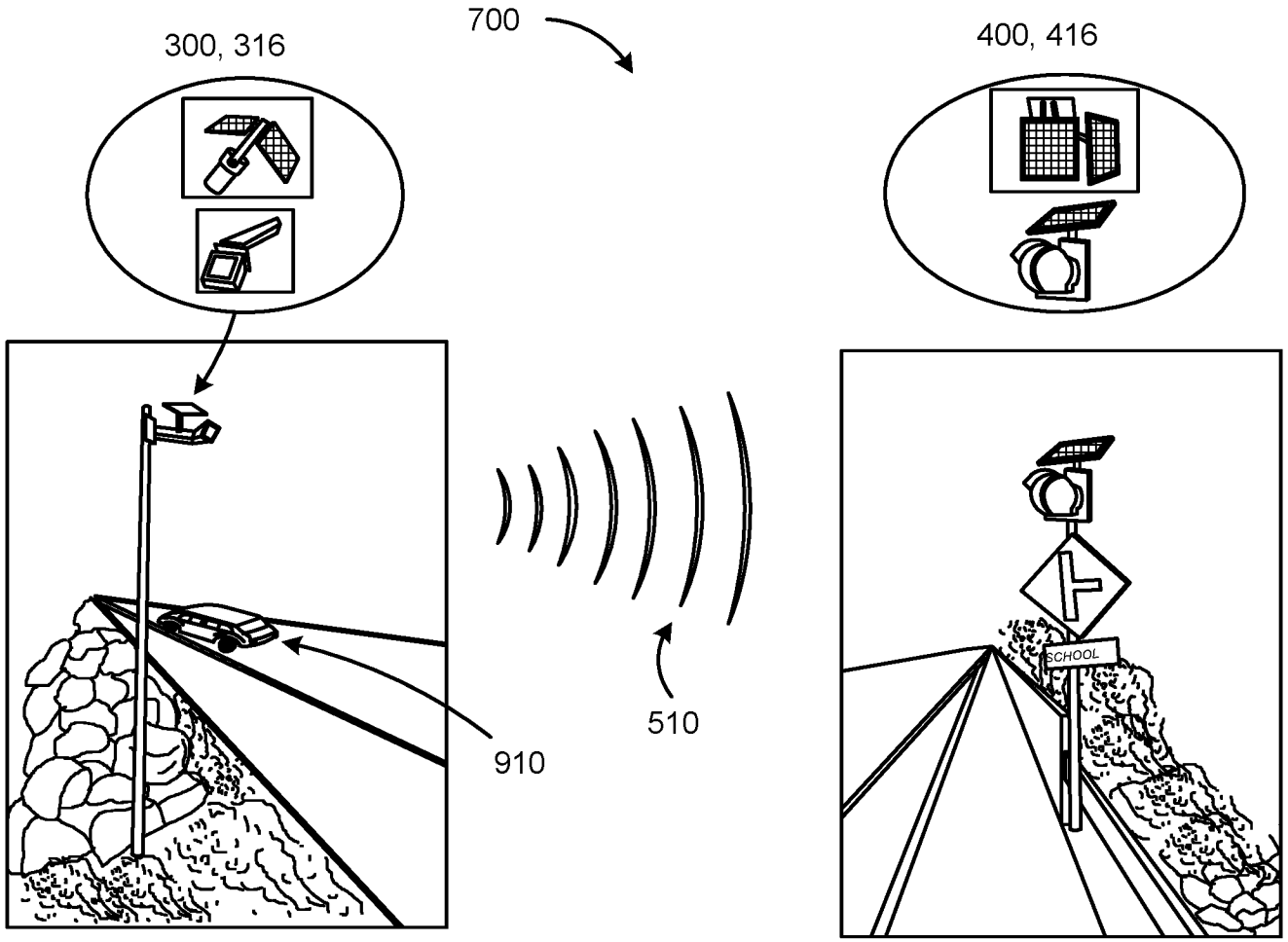
FIG. 9 illustrates a pictorial view of an exemplary method of vehicle activated wireless communications of the sensing devices and flashers for providing alerts to a vehicle driver, in accordance with an embodiment of the present invention.

FIG. 9 illustrates a pictorial view of an exemplary method of vehicle activated wireless communications of the sensing devices and flashers for providing alerts to a vehicle driver, in accordance with an embodiment of the present invention. As shown in FIG. 9, a flasher 400, 416 is located on a pole. A detector 316 is located on a second pole a distance away from the first pole. A car 910 may be detected by the detector 316 and the vehicle driver may be provided with an alert on school zone up ahead by a flasher 400, 416 in time for the vehicle driver to slow down the vehicle.

Figure 10:
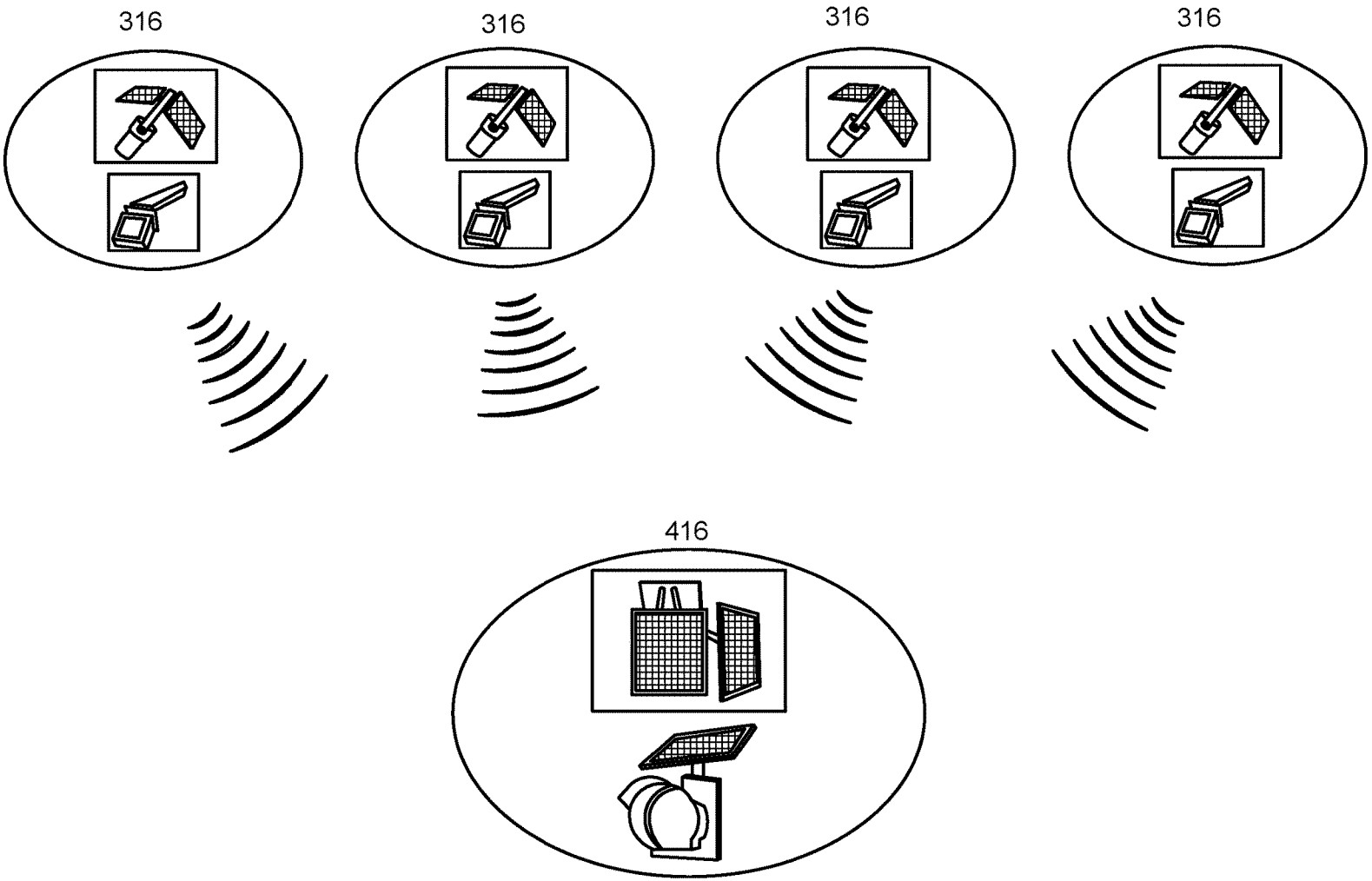
FIG. 10 illustrates a pictorial view of exemplary detectors and flashers for providing alerts to a vehicle driver, in accordance with an embodiment of the present invention.

FIG. 10 illustrates a pictorial view of exemplary detectors and flashers for providing alerts to a vehicle driver, in accordance with an embodiment of the present invention.

As shown at least in FIG. 6, an exemplary system 600 is provided for providing alerts to a vehicle driver, in accordance with an embodiment of the present invention. The system for providing alerts to a vehicle driver 100 comprises at least a sensing device 316, a receiving device 416, a user (a vehicle driver, not shown in figure), a display device integrated with the receiving device (a flasher i.e., 412, 420), at least a computing system (not shown in figure, but placed inside the battery housing of the receiving device and inside the sensing device), and at least a storage device (not shown in figure, but placed inside the battery housing of the receiving device). The display device includes a display screen in the form of a beacon or a traffic signal with LED lights. The computing system may include a visual input device, visual output device, a database and a miscellaneous data input interface.

During a typical operation of the system 600 the visual input device in the sensing device is used to capture a road situation where the sensing device i.e., detector is placed.

The road situation could include a pedestrian crossing the road, a road condition, a road attribute, a road blockage and the like situations faced by a vehicle driver while driving on a road.

It may be appreciated by a person with ordinary skill in the art, in light of and in accordance with the teachings of the present invention, the computing system may include virtually any computer device capable of capturing, processing, and displaying the road situation (by the sensing device), providing a wireless communication to the receiving device (by the sensing device), receiving a wireless communication from the sensing device (by the receiving device in the flasher), analyzing the situation by the computing device in the flasher, and switching-ON the alert for the vehicle driver if required. Non-limiting examples of the computing systems include a computer. The computing system may include any computing platform that executes computer software and/or code from a non-transitory computer readable medium. The computing system may include a single device or multiple devices. In embodiments where the computing device is a single device all the functions of capturing the video, processing, and formatting gathered information, organizing the capture information, transmitting the capture information to the receiving computer device and rendering the alerts, may be executed by the computer system. In embodiments where the computing system includes multiple devices these functions may be distributed between the multiple devices. For example, the gathering, processing, formatting, and organization of information may be done by one computer system and the transmitting of the organized information to the receiving device and switching-ON the alert may be executed by a second device. In another embodiment, the computing system includes multiple devices.

It may be appreciated by a person with ordinary skill in the art, in light of and in accordance with the teachings of the present invention, that the computing system may connect to any number of devices with virtually any wired and/or wireless means. The computing system may connect to virtually any device by means such as, but not limited to, Bluetooth connection, Ethernet cable, USB cable, WIFI, IRDA, etc. . . .

It may be appreciated by a person with ordinary skill in the art, in light of and in accordance with the teachings of the present invention, that the visual input device may be any device capable of capturing an image. Visual input device may include devices such as, but not limited to, digital cameras, web cameras, video cameras, etc. In another embodiment of the present invention, visual input device may be an integrated web camera on a personal computer, tablet or laptop.

It may be appreciated by a person with ordinary skill in the art, in light of and in accordance with the teachings of the present invention, that the voice input device may be any device capable of capturing audible noises. Voice input device may include devices such as, but not limited to, digital cameras, web cameras, video cameras, voice recorders, etc. In another embodiment of the present invention, voice input device may be an integrated voice recorder on a personal computer, tablet or laptop.

It may be appreciated by a person with ordinary skill in the art, in light of and in accordance with the teachings of the present invention, a miscellaneous data input interface may be virtually any data input interface capable of capturing road condition attributes. The database may be, but not limited to, a plurality of data servers, and a memory card. It may be appreciated by a person with ordinary skill in the art, in light of and in accordance with the teachings of the present invention, that the database (containing user's organized information) may contain virtually any road situation data to adapt the functionality of the alert system based on a detected road condition. In another embodiment, the data may be stored in a memory card in the computing system.

It may be appreciated by a person with ordinary skill in the art, in light of and in accordance with the teachings of the present invention, the organized user information gathered may partially or completely be contained in a local computing platform and/or network. In an alternative embodiment of the present invention, the organized user information gathered may be located on a local computer network.

It may be appreciated by a person with ordinary skill in the art, in light of and in accordance with the teachings of the present invention, the storage device may include any portable storage device or the storage device may be internet based. Non-limiting examples of portable storage media include computer readable devices like USB, DVD, etc. . . . Non-limiting examples of internet based storage media include cloud drive, data download web link, etc . . . . The information may be stored in a local computing platform and/or network. In an alternative embodiment of the present invention, the information gathered may be located on a local computer network.

Figure 11:
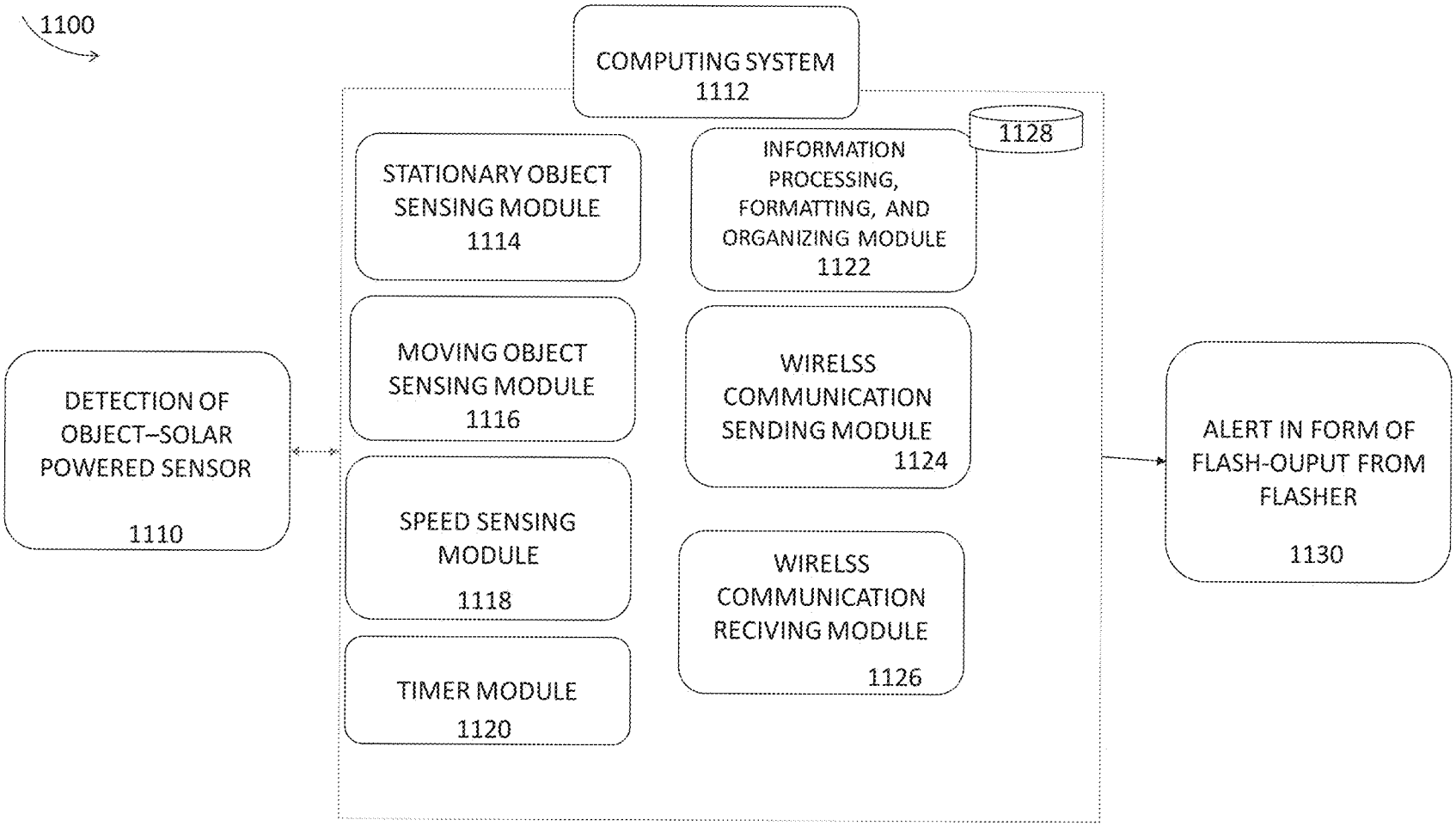
FIG. 11 illustrates a block diagram architecture of an exemplary system for providing alerts to a vehicle driver, in accordance with an embodiment of the present invention.

FIG. 11 illustrates a block diagram architecture of an exemplary system for providing an alert to a vehicle driver, in accordance with an embodiment of the present invention. A system for providing an alert to a vehicle driver architecture 1100 may comprise a computing system 1112. The computing system 1112 includes a stationary object sensing module 1114, a moving object sensing module 1116, a speed sensing module 1118, a timer module 1120, an information processing, formatting, and organizing module 1122, a wireless communication sending module 1124, a wireless communication receiving module 1126, a database module 1128, and an alert generating module 1130. The stational object sensing module 1114, may have a means of capturing an image (still and moving image), such as, without limitation, a camera or virtually any camera, of a road situation. The moving object sensing module 1116, may have a means of capturing a moving image, such as, without limitation, a camera or virtually any camera, of a road situation. The speed sensing module 1118 may have a means of sensing the speed of the object, such as, without limitation, a pedestrian on a road. A timer module 1120 may have a means of sending timed alerts based on the information received from sensing module on the road situation. Information processing, formatting, and organizing module 1122 may have a means of processing an image, and the gathered information, such as, without limitation, a processing unit, a computer, or a server to execute computer code and/or algorithms from a non-transitory computer readable medium for image recognition. A wireless communication sending module 1124 and a wireless communication receiving module 1126 may be configure with a wireless transceiver capable of sending and receiving information received about road condition to enable the alert generating module 1130 to alert a vehicle driver, which in the present exemplary embodiment is done by way of displaying a flashing beacon or a traffic signal for vehicle drivers to take necessary evasive action. However, those skilled in the art, in light of the teachings of the present invention, and depending on the needs of the particular application, will readily recognize a multiplicity of alternative and suitable ways to alert vehicle drivers as to the potential dangers detected by the foregoing system, which, may include, without limitation, and in any suitable combination, various visual light signaling, acoustic signaling, semaphore signaling, etc.

It may be appreciated by a person with ordinary skill in the art, in light of and in accordance with the teachings of the present invention, that one or more modules may be embodied in a single device or in multiple devices.

It may be appreciated by a person with ordinary skill in the art, in light of and in accordance with the teachings of the present invention, that virtually any algorithm and/or computer code may be used to recognize and capture a visual on the visual attributes capture module and the information processing, formatting, and organizing module. Visual recognition algorithms and/or methods may include, without limitation, Bayesian networks, fuzzy logic, neural networks, template matching, Hidden Markov models, machine learning, data mining, feature extraction and data analysis/statistics, optical character recognition, etc. In an alternative embodiment of the present invention, a binary search tree may be implemented to extract data from a visual.

It may be appreciated by a person with ordinary skill in the art, in light of and in accordance with the teachings of the present invention, that there may be a plurality of the same modules in the architecture 1100. A plurality of modules such as, without limitation, a stationary object sensing module 1114, a moving object sensing module 1116, a speed sensing module 12118, a timer module 1120, an information processing, formatting, and organizing module 1122, a wireless communication sending module 1124, a wireless communication receiving module 1126, a database module 1128, and an alert generating module 1130 may be present in the architecture 1100. The plurality of similar modules may work in parallel or independently to improve the throughput and/or speed of the architecture 200. In an alternative embodiment of the present invention, a plurality of capture, processing, formatting, and organizing, generation, display, interface, and storage modules may be connected to the system via wired and wireless connections to access resources from different wired and wireless networks. In still another alternative embodiment of the present invention, a plurality of similar modules may form a secondary system capable of seamlessly substituting an errant module.

It may be appreciated by a person with ordinary skill in the art, in light of and in accordance with the teachings of the present invention, that one or more modules may transmit capture information to a tech support server that is on an accessible network or over the internet.

It may be appreciated by a person with ordinary skill in the art, in light of and in accordance with the teachings of the present invention, that any module in the architecture 1100 may perform data manipulation. Data manipulation such as, but not limited to, compression, encryption, formatting. In an alternative embodiment of the present invention, any module sending data may first compress the data prior to data transmission.

Those skilled in the art will readily recognize, in light of and in accordance with the teachings of the present invention, that any of the foregoing steps and/or system modules may be suitably replaced, reordered, removed and additional steps and/or system modules may be inserted depending upon the needs of the particular application, and that the systems of the foregoing embodiments may be implemented using any of a wide variety of suitable processes and system modules, and is not limited to any particular computer hardware, software, middleware, firmware, microcode and the like. For any method steps described in the present application that can be carried out on a computing machine, a typical computer system can, when appropriately configured or designed, serve as a computer system in which those aspects of the invention may be embodied.

Figure 12:
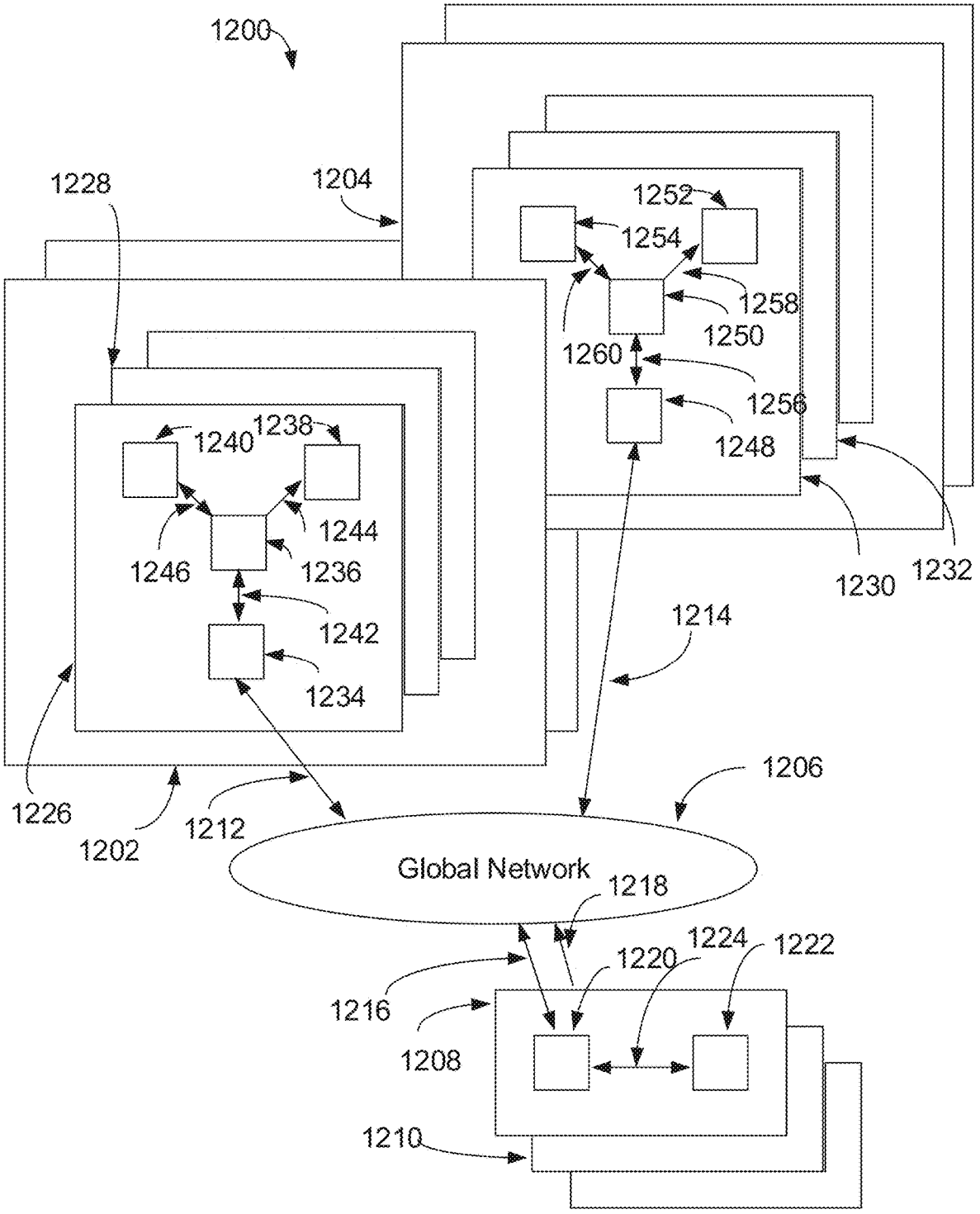
FIG. 12 illustrates a block diagram depicting a conventional client/server communication system, which may be used by an exemplary web-enabled/networked embodiment of the present invention.

FIG. 12 illustrates a block diagram depicting a conventional client/server communication system, which may be used by an exemplary web-enabled/networked embodiment of the present invention.

A communication system 1200 includes a multiplicity of networked regions with a sampling of regions denoted as a network region 1202 and a network region 1204, a global network 1206 and a multiplicity of servers with a sampling of servers denoted as a server device 1208 and a server device 1210.

Network region 1202 and network region 1204 may operate to represent a network contained within a geographical area or region. Non-limiting examples of representations for the geographical areas for the networked regions may include postal zip codes, telephone area codes, states, counties, cities and countries. Elements within network region 1202 and 1204 may operate to communicate with external elements within other networked regions or within elements contained within the same network region.

In some implementations, global network 1206 may operate as the Internet. It will be understood by those skilled in the art that communication system 1200 may take many different forms. Non-limiting examples of forms for communication system 1200 include local area networks (LANs), wide area networks (WANs), wired telephone networks, cellular telephone networks or any other network supporting data communication between respective entities via hardwired or wireless communication networks. Global network 1206 may operate to transfer information between the various networked elements.

Server device 1208 and server device 1210 may operate to execute software instructions, store information, support database operations and communicate with other networked elements. Non-limiting examples of software and scripting languages which may be executed on server device 1208 and server device 1210 include C, C++, C# and Java.

Network region 1202 may operate to communicate bi-directionally with global network 1206 via a communication channel 1212. Network region 1204 may operate to communicate bi-directionally with global network 1206 via a communication channel 1214. Server device 1208 may operate to communicate bi-directionally with global network 1206 via a communication channel 1216. Server device 1210 may operate to communicate bi-directionally with global network 1206 via a communication channel 1218. Network region 1202 and 1204, global network 1206 and server devices 1208 and 1210 may operate to communicate with each other and with every other networked device located within communication system 1200.

Server device 1208 includes a networking device 1220 and a server 1222. Networking device 1220 may operate to communicate bi-directionally with global network 1206 via communication channel 1216 and with server 1222 via a communication channel 1224. Server 1222 may operate to execute software instructions and store information.

Network region 1202 includes a multiplicity of clients with a sampling denoted as a client 1226 and a client 1228. Client 1226 includes a networking device 1234, a processor 1236, a GUI 1238 and an interface device 1240. Non-limiting examples of devices for GUI 1238 include monitors, televisions, cellular telephones, smartphones and PDAs (Personal Digital Assistants). Non-limiting examples of interface device 1240 include pointing device, mouse, trackball, scanner and printer. Networking device 1234 may communicate bi-directionally with global network 1206 via communication channel 1212 and with processor 1236 via a communication channel 1242. GUI 1238 may receive information from processor 1236 via a communication channel 1244 for presentation to a user for viewing. Interface device 1240 may operate to send control information to processor 1236 and to receive information from processor 1236 via a communication channel 1246. Network region 1204 includes a multiplicity of clients with a sampling denoted as a client 1230 and a client 1232. Client 1230 includes a networking device 1248, a processor 1250, a GUI 1252 and an interface device 1254. Non-limiting examples of devices for GUI 1238 include monitors, televisions, cellular telephones, smartphones and PDAs (Personal Digital Assistants). Non-limiting examples of interface device 1240 include pointing devices, mousse, trackballs, scanners and printers. Networking device 1248 may communicate bi-directionally with global network 1206 via communication channel 1214 and with processor 1250 via a communication channel 1256. GUI 1252 may receive information from processor 1250 via a communication channel 1258 for presentation to a user for viewing. Interface device 1254 may operate to send control information to processor 1250 and to receive information from processor 1250 via a communication channel 1260.

For example, consider the case where a user interfacing with client 1226 may want to execute a networked application. A user may enter the IP (Internet Protocol) address for the networked application using interface device 1240. The IP address information may be communicated to processor 1236 via communication channel 1246. Processor 1236 may then communicate the IP address information to networking device 1234 via communication channel 1242. Networking device 1234 may then communicate the IP address information to global network 1206 via communication channel 1212. Global network 1206 may then communicate the IP address information to networking device 1220 of server device 1208 via communication channel 1216. Networking device 1220 may then communicate the IP address information to server 1222 via communication channel 1224. Server 1222 may receive the IP address information and after processing the IP address information may communicate return information to networking device 1220 via communication channel 1224. Networking device 1220 may communicate the return information to global network 1206 via communication channel 1216. Global network 1206 may communicate the return information to networking device 1234 via communication channel 1212. Networking device 1234 may communicate the return information to processor 1236 via communication channel 1242. Processor 12126 may communicate the return information to GUI 12128 via communication channel 1244. User may then view the return information on GUI 1238.

Figure 13:
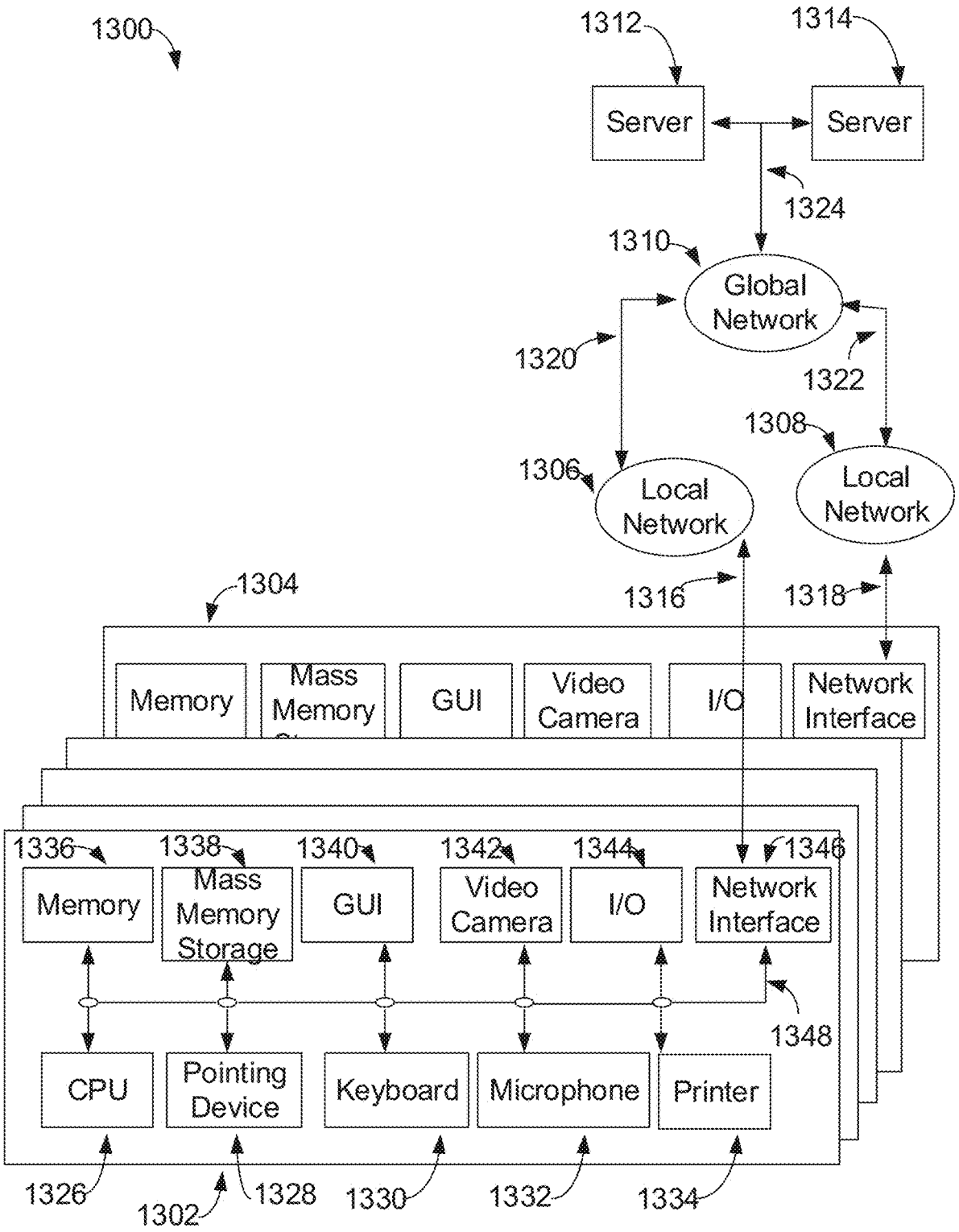
FIG. 13 is a block diagram depicting an exemplary client/server system which may be used by an exemplary web-enabled/networked embodiment of the present invention.

FIG. 13 is a block diagram depicting an exemplary client/server system which may be used by an exemplary web-enabled/networked embodiment of the present invention.

A communication system 1300 includes a multiplicity of clients with a sampling of clients denoted as a client 1302 and a client 1304, a multiplicity of local networks with a sampling of networks denoted as a local network 1306 and a local network 1308, a global network 1310 and a multiplicity of servers with a sampling of servers denoted as a server 1312 and a server 1314.

Client 1302 may communicate bi-directionally with local network 1306 via a communication channel 1316. Client 1304 may communicate bi-directionally with local network 1308 via a communication channel 1318. Local network 1306 may communicate bi-directionally with global network 1310 via a communication channel 1320. Local network 1308 may communicate bi-directionally with global network 1310 via a communication channel 1322. Global network 1310 may communicate bi-directionally with server 1312 and server 1314 via a communication channel 1324. Server 1312 and server 1314 may communicate bi-directionally with each other via communication channel 1324. Furthermore, clients 1302, 1304, local networks 1306, 1308, global network 1310 and servers 1312, 1314 may each communicate bi-directionally with each other.

In one embodiment, global network 1310 may operate as the Internet. It will be understood by those skilled in the art that communication system 1300 may take many different forms. Non-limiting examples of forms for communication system 1300 include local area networks (LANs), wide area networks (WANs), wired telephone networks, wireless networks, or any other network supporting data communication between respective entities.

Clients 1302 and 1304 may take many different forms. Non-limiting examples of clients 1302 and 1304 include personal computers, personal digital assistants (PDAs), cellular phones and smartphones.

Client 1302 includes a CPU 1326, a pointing device 1328, a keyboard 1330, a microphone 1332, a printer 1334, a memory 1336, a mass memory storage 1338, a GUI 1340, a video camera 1342, an input/output interface 1344 and a network interface 1346.

CPU 1326, pointing device 1328, keyboard 1330, microphone 1332, printer 1334, memory 1336, mass memory storage 1338, GUI 1340, video camera 1342, input/output interface 1344 and network interface 1346 may communicate in a unidirectional manner or a bi-directional manner with each other via a communication channel 1348. Communication channel 1348 may be configured as a single communication channel or a multiplicity of communication channels.

CPU 1326 may be comprised of a single processor or multiple processors. CPU 1326 may be of various types including micro-controllers (e.g., with embedded RAM/ROM) and microprocessors such as programmable devices (e.g., RISC or SISC based, or CPLDs and FPGAs) and devices not capable of being programmed such as gate array ASICs (Application Specific Integrated Circuits) or general purpose microprocessors.

As is well known in the art, memory 1336 is used typically to transfer data and instructions to CPU 1326 in a bi-directional manner. Memory 1336, as discussed previously, may include any suitable computer-readable media, intended for data storage, such as those described above excluding any wired or wireless transmissions unless specifically noted. Mass memory storage 1338 may also be coupled bi-directionally to CPU 1326 and provides additional data storage capacity and may include any of the computer-readable media described above. Mass memory storage 1338 may be used to store programs, data and the like and is typically a secondary storage medium such as a hard disk. It will be appreciated that the information retained within mass memory storage 1338, may, in appropriate cases, be incorporated in standard fashion as part of memory 1336 as virtual memory.

CPU 1326 may be coupled to GUI 1340. GUI 1340 enables a user to view the operation of computer operating system and software. CPU 1326 may be coupled to pointing device 1328. Non-limiting examples of pointing device 1328 include computer mouse, trackball and touchpad.

Pointing device 1328 enables a user with the capability to maneuver a computer cursor about the viewing area of GUI 1340 and select areas or features in the viewing area of GUI 1340. CPU 1326 may be coupled to keyboard 1330. Keyboard 1330 enables a user with the capability to input alphanumeric textual information to CPU 1326. CPU 1326 may be coupled to microphone 1332. Microphone 1332 enables audio produced by a user to be recorded, processed and communicated by CPU 1326. CPU 1326 may be connected to printer 1334. Printer 1334 enables a user with the capability to print information to a sheet of paper. CPU 1326 may be connected to video camera 1342. Video camera 1342 enables video produced or captured by user to be recorded, processed and communicated by CPU 1326.

CPU 1326 may also be coupled to input/output interface 1344 that connects to one or more input/output devices such as such as CD-ROM, video monitors, track balls, mice, keyboards, microphones, touch-sensitive displays, transducer card readers, magnetic or paper tape readers, tablets, styluses, voice or handwriting recognizers, or other well-known input devices such as, of course, other computers.

Finally, CPU 1326 optionally may be coupled to network interface 1346 which enables communication with an external device such as a database or a computer or telecommunications or internet network using an external connection shown generally as communication channel 1316, which may be implemented as a hardwired or wireless communications link using suitable conventional technologies. With such a connection, CPU 1326 might receive information from the network, or might output information to a network in the course of performing the method steps described in the teachings of the present invention.

It will be further apparent to those skilled in the art that at least a portion of the novel method steps and/or system components of the present invention may be practiced and/or located in location(s) possibly outside the jurisdiction of the United States of America (USA), whereby it will be accordingly readily recognized that at least a subset of the novel method steps and/or system components in the foregoing embodiments must be practiced within the jurisdiction of the USA for the benefit of an entity therein or to achieve an object of the present invention. Thus, some alternate embodiments of the present invention may be configured to comprise a smaller subset of the foregoing means for and/or steps described that the applications designer will selectively decide, depending upon the practical considerations of the particular implementation, to carry out and/or locate within the jurisdiction of the USA. For example, any of the foregoing described method steps and/or system components which may be performed remotely over a network (e.g., without limitation, a remotely located server) may be performed and/or located outside of the jurisdiction of the USA while the remaining method steps and/or system components (e.g., without limitation, a locally located client) of the forgoing embodiments are typically required to be located/performed in the USA for practical considerations. In client-server architectures, a remotely located server typically generates and transmits required information to a US based client, for use according to the teachings of the present invention. Depending upon the needs of the particular application, it will be readily apparent to those skilled in the art, in light of the teachings of the present invention, which aspects of the present invention can or should be located locally and which can or should be located remotely. Thus, for any claims construction of the following claim limitations that are construed under 35 USC § 112 (6) it is intended that the corresponding means for and/or steps for carrying out the claimed function are the ones that are locally implemented within the jurisdiction of the USA, while the remaining aspect(s) performed or located remotely outside the USA are not intended to be construed under 35 USC § 112 (6). In some embodiments, the methods and/or system components which may be located and/or performed remotely include, without limitation:

It is noted that according to USA law, all claims must be set forth as a coherent, cooperating set of limitations that work in functional combination to achieve a useful result as a whole. Accordingly, for any claim having functional limitations interpreted under 35 USC § 112 (6) where the embodiment in question is implemented as a client-server system with a remote server located outside of the USA, each such recited function is intended to mean the function of combining, in a logical manner, the information of that claim limitation with at least one other limitation of the claim. For example, in client-server systems where certain information claimed under 35 USC § 112 (6) is/(are) dependent on one or more remote servers located outside the USA, it is intended that each such recited function under 35 USC § 112 (6) is to be interpreted as the function of the local system receiving the remotely generated information required by a locally implemented claim limitation, wherein the structures and or steps which enable, and breath life into the expression of such functions claimed under 35 USC § 112 (6) are the corresponding steps and/or means located within the jurisdiction of the USA that receive and deliver that information to the client (e.g., without limitation, client-side processing and transmission networks in the USA). When this application is prosecuted or patented under a jurisdiction other than the USA, then "USA" in the foregoing should be replaced with the pertinent country or countries or legal organization(s) having enforceable patent infringement jurisdiction over the present application, and "35 USC § 112 (6)" should be replaced with the closest corresponding statute in the patent laws of such pertinent country or countries or legal organization(s).

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC § 112 (1), all claims must be supported by sufficient disclosure in the present patent specification, and any material known to those skilled in the art need not be explicitly disclosed. However, 35 USC § 112 (6) requires that structures corresponding to functional limitations interpreted under 35 USC § 112 (6) must be explicitly disclosed in the patent specification. Moreover, the USPTO's Examination policy of initially treating and searching prior art under the broadest interpretation of a "mean for" or "steps for" claim limitation implies that the broadest initial search on 35 USC § 112(6) (post AIA 112(f)) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC § 112(6) (post AIA 112(f)) when such corresponding structures are not explicitly disclosed in the foregoing patent specification. Therefore, for any invention element(s)/structure(s) corresponding to functional claim limitation(s), in the below claims interpreted under 35 USC § 112(6) (post AIA 112(f)), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC § 112(6) (post AIA 112(f)) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3rd parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC § 112(6) (post AIA 112(f)), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC § 112 (6). Applicant(s) note that all the identified documents above which are incorporated by reference to satisfy 35 USC § 112 (6) necessarily have a filing and/or publication date prior to that of the instant application, and thus are valid prior documents to incorporated by reference in the instant application.

Having fully described at least one embodiment of the present invention, other equivalent or alternative methods of implementing a system and method for alerting vehicle drivers i.e., road safety according to the present invention will be apparent to those skilled in the art. Various aspects of the invention have been described above by way of illustration, and the specific embodiments disclosed are not intended to limit the invention to the particular forms disclosed. The particular implementation of the system and method for alerting vehicle drivers may vary depending upon the particular context or application. By way of example, and not limitation, the system and method for alerting vehicle drivers described in the foregoing were principally directed to alerting vehicle drivers to road situations including pedestrian crossing, road blockages etc. using a remote detection and warning systems i.e., a distributed sensing flashing beacon implementation i.e., turn on/off solar-powered flashers using multiple solar-powered sensors remotely and spatially distributed; however, similar techniques may instead be applied to other applications such as, without limitation, parking lot gate where flashers can help drivers avoid breaking through gate, vehicle alerting signals at parking garage where vehicles in opposite directions may collide at blind spots, exits of parking lot or parking garage, emergency alerting signals at facilities such as schools triggered manually by security personnel, and etc., which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. That is, the Abstract is provided merely to introduce certain concepts and not to identify any key or essential features of the claimed subject matter. It is submitted with the understanding that it will not be used to limit or interpret the scope or meaning of the claims.

The following claims are hereby incorporated into the detailed description, with each claim standing on its own as a separate embodiment.

What is claimed is:

1. A system consisting of:

means for alerting at least one of vehicle drivers and pedestrians at a predetermined location;

means for sensing a presence of at least one of vehicles and pedestrians, wherein said presence sensing means comprises a plurality of presence detecting means, and wherein said presence sending means is configured to transmit a wireless detection signal based on detecting a presence of at least one vehicle or pedestrian at said predetermined location;

means for activating said alerting means based on at least one of said plurality of presence detecting means detecting a presence of at least one vehicle or pedestrian;

means for wireless communication having receiving means disposed on said means for activating said alerting means, said means for wireless communication is operable for receiving said wireless detection signal, wherein said means for activating said alerting means activates said alerting means upon said means for wireless communications having receiving means receiving said transmitted wireless detection signal;

wherein each of said plurality of presence detecting means is disposed at different locations configured to be operable for detecting at least one of said vehicles and pedestrians over a short period of time and transmit said wireless detection signal based on detecting said presence of said at least one vehicle or pedestrian to said means for activating said alerting means;

means for controlling at least one of a flashing interval and a flashing pattern of said alerting means based on said wireless detection signal from said plurality of presence detecting means placed at different locations for detecting at least one of said vehicles and pedestrians; and means for controlling said alerting means to turn on and flash in at least one of said flashing interval and flashing pattern based on predetermined time intervals.

2. A system comprising:

an alert generating module, wherein said alert generating module is configured to be operable for alerting at least one of vehicle drivers and pedestrians;

a sensor module, wherein said sensor module is configured to detect a presence of at least one of vehicles and pedestrians, and wherein said sensor module is further configured to transmit a wireless detection signal based on detecting a presence of at least one vehicle or pedestrian at said predetermined location;

a control panel, wherein said control panel is configured to be operable for activating said alert generating module based on said sensor module detecting a presence of at least one vehicle or pedestrian;

a first wireless communication having a receiving module disposed on said control panel, said wireless communications having a receiving module is operable for receiving said transmitted wireless detection signal, wherein said control panel activates said alert generating module upon said wireless communications having a receiving module receiving said transmitted wireless detection signal;

wherein said sensor module comprises a plurality of detectors disposed at different locations, and wherein each of said plurality of detectors is configured to detect at least one vehicle or pedestrian over a short period of time and transmit said wireless detection signal based on detecting said presence of said at least one vehicle or pedestrian to said alert generating module;

a relay device, said relay device is configured to be operable for controlling at least one of a flashing interval and a flashing pattern of said alert generating module based on said wireless detection signal from said plurality of detectors placed at different locations for detecting at least one of said vehicles and pedestrians; and a timer module, said timer module is configured to be operable for controlling at least one of said flashing interval and flashing pattern based on predetermined time intervals.

3. The system of claim 2, further comprising a second wireless communication having a sending module disposed on said sensor module, said wireless communication having a sending module is configured to wirelessly send a signal based on said detection of at least one vehicle or pedestrian.

4. The system of claim 3, in which said second wireless communication having a sending module comprises a plurality of wireless communications each having a sending module disposed on each of said plurality of detectors, each of said plurality of wireless communications each having a sending module is configured to wirelessly send a detection signal based on a detection of at least one of said vehicle and pedestrian.

5. The system of claim 3, further comprising a first battery implement and a first housing operable for holding said first battery implement, said first battery implement is configured to supply power to said alert generating module.

6. The system of claim 5, further comprising a first solar panel, said first solar panel is configured to charge said first battery implement.

7. The system of claim 6, further comprising a second battery implement configured to supply power to said sensor module.

8. The system of claim 7, further comprising a second solar panel, said second solar panel is configured to supply power to said second battery implement.

9. The system of claim 8, in which said solar powered sign flasher flashes a sign including "driving in wrong direction" upon detection of at least one of said vehicle and pedestrian.

10. The system of claim 8, in which said solar powered beacon continuously flash upon detection of at least one of said vehicle and pedestrian.

11. The system of claim 10, in which said plurality of detectors comprises at least one of, one or more stationary object sensing modules, one or more moving object sensing modules, and one or more speed sensing modules.

12. The system of claim 11, in which said one or more stationary object sensing modules is configured to capture a still image of at least one of said vehicle and pedestrian.

13. The system of claim 12, in which said one or more moving object sensing modules is configured to capture a moving image of at least one of said vehicle and pedestrian.

14. The system of claim 13, in which said one or more speed sensing modules is configured to capture a speed of at least one of said vehicle and pedestrian.

15. The system of claim 8, further comprising a mounting bracket, said mounting bracket is configured to engage said second battery implement, second solar panel, and said sensor module.

16. The system of claim 4, in which said alert generating module comprises a plurality of solar powered beacon or sign flashers, each of said plurality of solar powered beacon or sign flashers is disposed at various predetermined locations.

17. The system of claim 16, further comprising a plurality of batteries, wherein each of said plurality of batteries is configured to supply power to each of said plurality of solar powered beacon or sign flashers.

18. The system of claim 17, further comprising a plurality of solar panels, each of said plurality of solar panels is configured to charge each of said plurality of batteries.

19. The system of claim 18, further comprising a plurality of mounting brackets, wherein each of said plurality of mounting brackets is configured to engage each of said plurality of solar powered beacon or sign flashers, each of said plurality of batteries, and each of said plurality of solar panels.

20. A system consisting of:

means for detecting a presence and movement or speed of at least a vehicle;

a wireless communication sending module, said wireless communication sending module is configured to wirelessly send a detection signal based on said detection of said presence and movement or speed of said vehicle;

means for alerting a driver of said vehicle or a pedestrian based on said detection of a presence and movement or speed of said vehicle;

a wireless communication receiver module coupled to said alerting means, wherein said wireless communication receiver module is operable for receiving said wireless detection signal;

a control panel, wherein said control panel is configured to be operable for activating said alerting means based on said received wireless detection signal;

a battery implement, said battery implement is configured to supply power to said alerting means;

a housing operable for holding said battery implement;

a solar panel, said solar panel is configured to charge said battery implement;

said alert generating module comprises at least one of a solar powered sign flasher that is configured to flash a sign including "driving in wrong direction" upon detection of said presence and movement or speed of said vehicle and a solar powered beacon that is configured to continuously flash upon detection said presence and movement or speed of said vehicle;

a relay device, said relay device is configured to be operable for controlling at least one of a flashing interval and a flashing pattern of said solar powered sign flasher or solar powered beacon based on said wireless detection signal;

a timer module, said timer module is configured to be operable for controlling at least one of said flashing interval and flashing pattern based on predetermined time intervals; and wherein said detecting means comprises a plurality of detecting means, each of said plurality of detecting means is disposed at various predetermined locations, and wherein each of said plurality of detecting means is configured to be operable for detecting a presence and movement or speed of said vehicle.

* * * * *